US007503791B2

(12) United States Patent
Fukaya et al.

(10) Patent No.: US 7,503,791 B2
(45) Date of Patent: Mar. 17, 2009

(54) CONNECTOR

(75) Inventors: Tomoyoshi Fukaya, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 11 days.

(21) Appl. No.: 11/823,912

(22) Filed: Jun. 29, 2007

(65) Prior Publication Data

US 2008/0003876 A1 Jan. 3, 2008

(30) Foreign Application Priority Data

Jun. 30, 2006 (JP) ..... 2006-180928
Jun. 30, 2006 (JP) ..... 2006-180931

(51) Int. Cl.
*H01R 13/52* (2006.01)

(52) U.S. Cl. ..... 439/275

(58) Field of Classification Search ..... 439/275, 439/274, 587, 589, 271, 677, 680
See application file for complete search history.

(56) References Cited

U.S. PATENT DOCUMENTS 5,613,868 A * 3/1997 Ohsumi et al. ..... 439/275
5,618,198 A * 4/1997 Sato et al. ..... 439/274
6,887,106 B2 5/2005 Noguchi et al.
2003/0162428 A1* 8/2003 Shinozaki et al. ..... 439/157

* cited by examiner

*Primary Examiner*—Felix O Figueroa
(74) *Attorney, Agent, or Firm*—Gerald E. Hespos; Anthony J. Casella

(57) ABSTRACT

A connector (F) has a housing (10) for accommodating a terminal fitting (30) connected with wire (W). A seal (98) is mounted on the wire (W) and fits in a mounting portion (15) in the rear of the housing (10). A holder (50) is mounted on the housing (10) from behind to press the seal (98) and to prevent the seal (98) from coming out. The holder (50) has a wire insertion hole (55) for receiving the wire (W). The seal (98) has a main body (96) and a shake preventing portion (94). The main body (96) closely contacts the outer surface of the wire W and the inner surface of the mounting portion (15). The shake preventing portion (94) closely contacts the outer surface of the wire (W) and the inner surface of the wire insertion hole (55) of the holder (50).

3 Claims, 21 Drawing Sheets

CONNECTOR

BACKGROUND OF THE INVENTION

1. Field of the Invention

The invention relates to a connector.

2. Description of the Related Art

U.S. Pat. No. 6,887,106 discloses a connector with a housing for accommodating a terminal fitting connected with an end of a wire. A sealing member is mounted on the wire and is fit into an opening at the rear end of the housing. A rear holder is mounted on the housing from behind to press and retain the sealing member. The rear holder is formed with a wire insertion hole through which the wire is passed, and the wire is drawn out to the outside through the wire insertion hole. The rear holder also is formed with a resiliently deformable locking piece that is engageable with an engaging portion on the circumferential surface of the housing. The locking piece engages the engaging portion when the rear holder is mounted properly on the housing to retain the rear holder on the housing.

The above-described connector is connected with a mating connector to connect the terminal fitting with a mating terminal fitting. However, the wire drawn out of the housing can be shaken in this state and can cause the wire in the housing to shake within the range of a clearance between the wire and the wire insertion hole. As a result, the terminal fittings might slide in contact with each other, and connected positions of both terminal fittings can change to impair connection reliability.

The connector disclosed in U.S. Pat. No. 6,887,106 has a terminal fitting connected with an end of a wire. The terminal fitting is inserted and held in a cavity of a housing, and a rubber plug is mounted on the end of the wire. A tubular mounting portion is formed at a rear part of the connector housing and has an open rear surface. The rubber plug is held in close contact with the inner circumferential surface of the mounting portion. A cap-shaped rear holder is mounted on the rear part of the housing for pressing the rubber plug from behind to retain the rubber plug. A back wall of the rear holder is formed with a wire insertion hole through which the wire is inserted. Further, the rear holder is formed with a resiliently deformable locking piece, and the rear holder is fixed to the connector housing by the mutual engagement of this locking piece with an interlocking portion projecting from the connector housing.

As noted above, the wire drawn out of the housing can be shaken transverse to the longitudinal direction and the shaking can cause the wire to press the inner surface of the wire insertion hole of the rear holder. These forces can disengage the interlocking portion and the locking piece and can detach the rear holder from the mounting portion.

The invention was developed in view of the above situation and an object thereof is to improve the overall operability of the connector, particularly by improving the connection reliability of a terminal fitting and/or by preventing a rear holder from being inadvertently detached from a mounting portion.

SUMMARY OF THE INVENTION

The invention relates to a connector with a housing for accommodating at least one terminal fitting connected with an end of a wire. At least one seal is mounted on the wire and is fit in an opening in the rear of the housing to seal the inside of the housing. A rear holder is formed with at least one wire insertion hole for receiving the wire. The rear holder is mounted on the housing from behind adapted and presses the seal to prevent the seal from coming out. The seal has a main body and at least one shake preventing portion arranged one after the other in forward and backward directions. The main body closely contacts the outer circumferential surface of the wire and the inner circumferential surface of the opening. The shake preventing portion closely contacts the outer circumferential surface of the wire and the inner circumferential surface of the wire insertion hole of the rear holder.

The wire drawn out of the housing may be shaken while the housing is connected with a mating housing. However, the shake preventing portion of the seal mounted on this wire closely contacts the outer circumferential surface of the wire and the inner circumferential surface of the wire insertion hole of the holder to suppress the shake of the wire in the housing. Thus, relative sliding movements of the terminal fitting connected with the end of this wire and a mating terminal fitting are avoided. Accordingly, connected positions of both terminal fittings are kept substantially constant to improve connection reliability. The seal fills a clearance between the wire insertion hole and the wire and corrects deviations of positional precision between the wire insertion hole and the wire, as compared to the case where the outer surface of the wire is held in close contact with the inner surface of the wire insertion hole.

The rear holder preferably has a rearwardly projecting tubular portion that includes the wire insertion hole. The shake preventing portion closely contacts the inner surface of the wire insertion hole in the tubular portion. Accordingly, the wire is contacted closely over the substantially entire length of the tubular portion to suppress shaking of the wire.

The inner circumferential surface of the wire insertion hole in the tubular portion preferably is tapered towards the rear end of the tubular portion, and the outer circumferential surface of the shake preventing portion is tapered substantially in conformity with the inner surface of the wire insertion hole. As a result, a shake support of the tubular portion closely holds the shake preventing portion of the seal to suppress shaking of the wire. Therefore, a shaking force of the wire is less likely to be transmitted to the connected parts of the both terminal fittings, thereby further improving the connection reliability.

The seal main body has a thickness to substantially fill a space between the outer circumferential surface of the wire and the inner circumferential surface of the mounting portion and most preferably has one lips on the inner and/or outer circumferential surfaces thereof.

The shake preventing portion preferably has substantially flat inner and/or outer circumferential surfaces.

The rear holder preferably has a substantially cap shape with a back wall and a surrounding wall. The surrounding wall projects forward from the back wall and is mountable on a mounting portion of the housing. The back wall has at least one wire insertion hole that can receive the wire drawn out through the respective surface of the housing. At least one leading-end widened rib extends substantially in forward and backward directions and is provided on one or both of the inner circumferential surface of the surrounding wall and the outer circumferential surface of the mounting portion. The leading-end widening rib has a leading end that is wider than a base end to define a dovetail or undercut shape. At least one recess is provided in the other surface at a position corresponding to the leading-end widened rib. The recess has a shape complementary to the leading-end widened rib for dovetail engagement.

The wire drawn out through the wire insertion hole of the holder may be shaken in a direction intersecting the forward and backward directions. As a result, there is a possibility that a pressing force will act on the holder in a shaking direction of the wire, and the holder may be detached from the housing. However, the leading-end widened rib and recess provide a dovetail engagement to define a positive joint or a form closure when the holder is mounted. Therefore, the holder will not detach from the housing even if the wire is shaken or the entire connector receives vibration.

The leading-end widened rib or the recess at the inner surface of the surrounding wall of the holder preferably extends substantially to the back wall of the holder to further prevent detachment of the holder.

The surrounding wall of the holder preferably is substantially cylindrical and the leading-end widened rib is provided on the inner circumferential surface of the surrounding wall. The leading-end widened rib may not be readily visible during mounting of the holder in view of the internal disposition of the leading-end widened rib. Accordingly, a recessed groove is formed in the outer circumferential surface of the surrounding wall at a position substantially radially aligned with the leading-end widened rib to define a back-to-back relationship. The recessed groove defines a marker to facilitate alignment of the internally disposed leading-end widened rib with the recess. As a result, the holder can be mounted precisely and efficiently on the mounting portion. Further, the disposition of the recessed groove back-to-back with the leading-end widened rib avoids an increase in the thickness of the surrounding wall and prevents an occurrence of a surface sink. Furthermore, the internal disposition of the leading-end widened rib assures that the leading-end widened rib will not be caught by external matter and broken.

The mounting portion preferably has a substantially tubular shape with an open rear end. The back wall of the holder includes an inner fitting to fit into the mounting portion. Thus, the mounting portion is held between the inner fitting and the surrounding wall in the thickness direction and the outer circumferential surface of the inner fitting closely contacts the inner circumferential surface of the mounting portion. Thus, the inner fitting remains closely fit in the mounting portion even if the wire is shaken a great amount for reliably preventing detachment of the holder from the housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
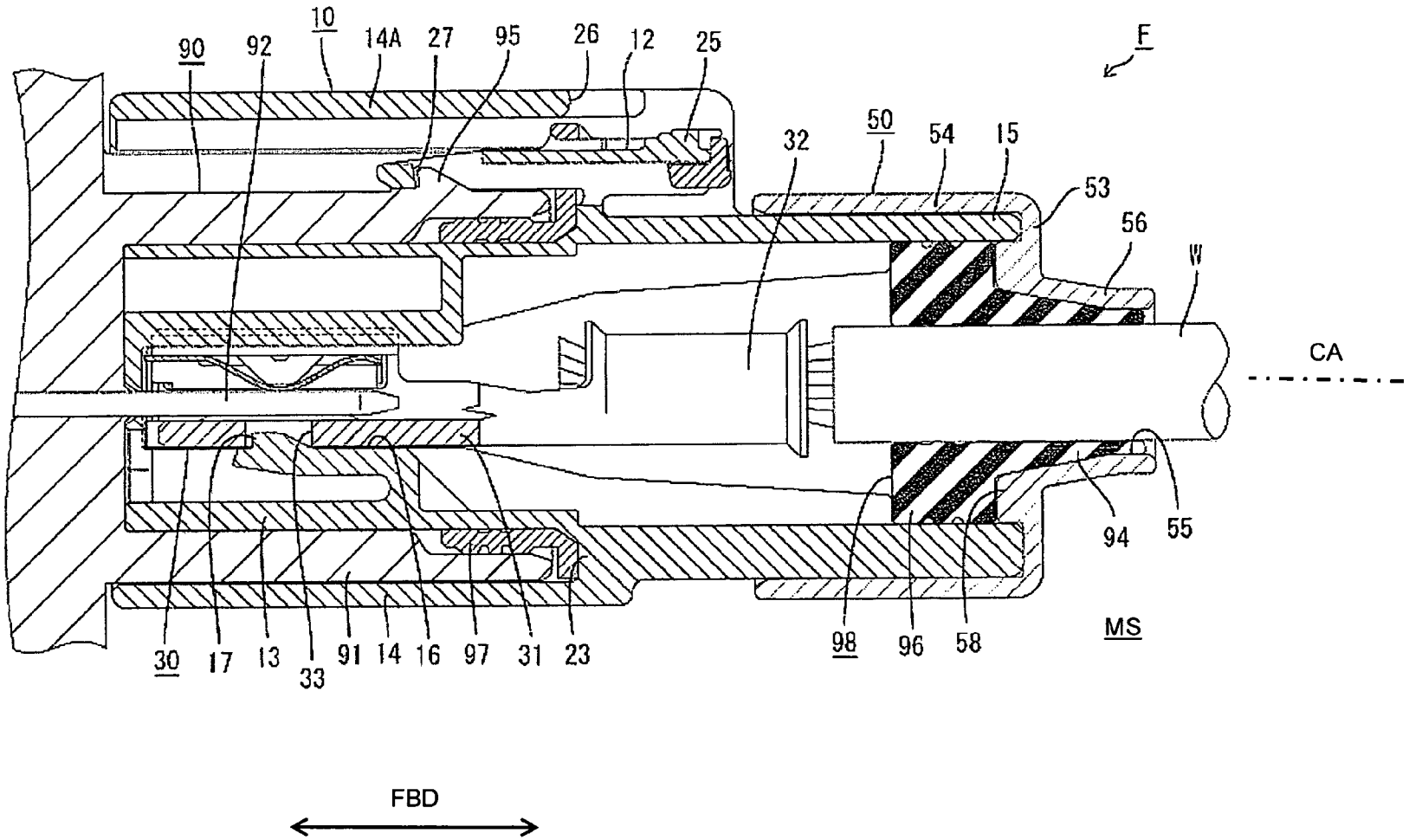
FIG. 1 is a side view in section of a connector according to a first embodiment connected with a mating connector.
Figure 2:
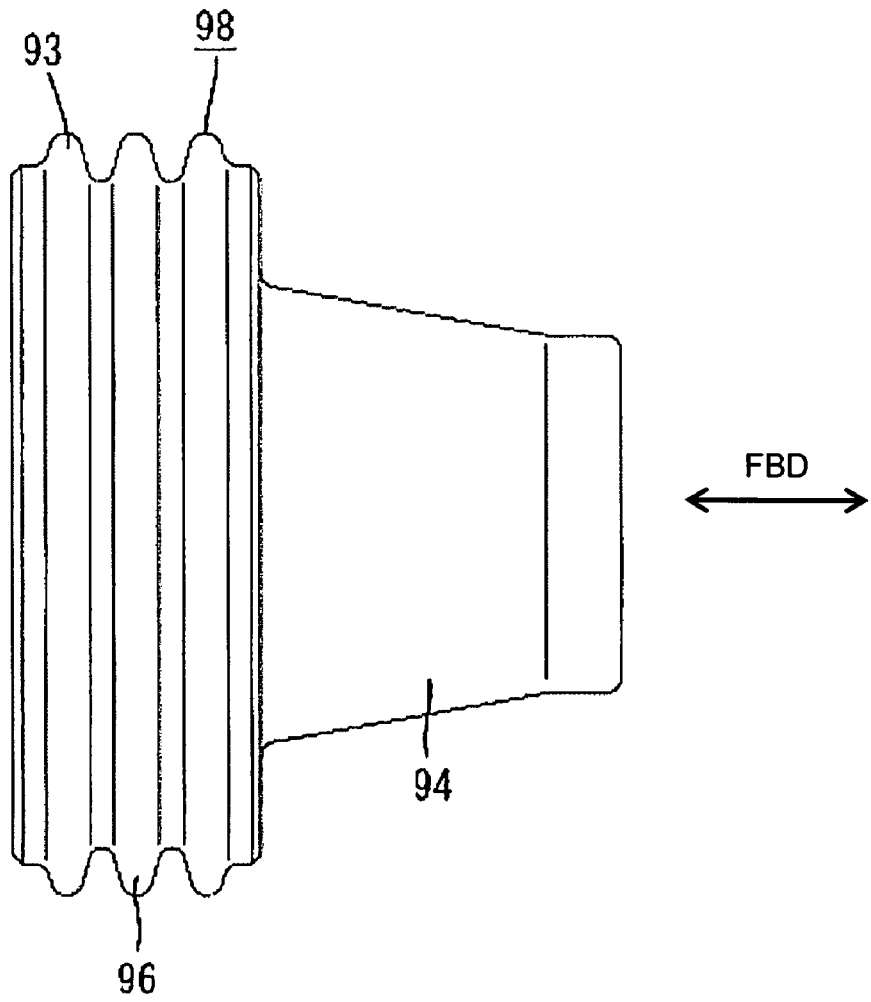
FIG. 2 is a side view of the connector connected with the mating connector.

A connector in accordance with a first embodiment of the invention is identified by the letter F in FIGS. 1 to 7. The connector F has a female housing 10 for accommodating a female terminal fitting 30 and a rear holder 50 to be mounted on the female housing 10 from a mounting side MS. The female housing 10 is connectable with a mating male housing 90. The connector F further has a seal 98 for providing fluid- or waterproof sealing between the female housing 10 and the terminal fitting 30 and a seal ring 97 for providing fluid- or waterproof sealing between the female and male housings 10 and 90. Ends of the female and male housings 10, 90 to be connected are referred to herein as the front ends concerning forward and backward directions FBD and reference is made to FIG. 1 concerning the vertical direction.

The mating male housing 90 is made e.g. of a synthetic resin and includes a round tubular receptacle 91 having an open front end. One male tab 92 is mounted through the back wall of the receptacle 91. The male tab 92 is a plate made of an electrically conductive material, such as a metal, and has a plate surface aligned along forward and backward directions FBD. Part of the male tab 92 projects into the receptacle 91. A lock 95 projects at an upper end part of the outer circumferential surface of the receptacle 91.

The female housing 10 is made e.g. of a synthetic resin and has opposite front and rear ends. A tower 13 is provided at the front end and can be fit into the receptacle 91 of the male housing 90. A fitting tube 14 is spaced outwardly from the tower 13 and the receptacle 91 can be inserted between the tower 13 and the fitting tube 14. A round tubular mounting portion 15 extends unitarily rearward from the tower 13, and has a larger diameter than the tower 13, but smaller a smaller diameter than the fitting tube 14. A cavity 16 penetrates the tower 13 in forward and backward directions FBD and communicates with the inner space of the mounting portion 15. One terminal fitting 30 is inserted from behind through the inner space of the mounting portion 15 and into the cavity 16.

The terminal fitting 30 has a substantially box-shaped main portion 31 for receiving the male tab 92. A wire connection barrel 32 is continuous with the rear end of the main portion 31 and can be crimped, bent or folded into connection with an exposed core at an end of a wire W. The main portion 31 can be fit into the cavity 16 of the tower 13 while the barrel 32 is arranged in the inner space of the fitting tube 14. The main portion 31 is formed with a locking hole 33 for receiving a lock 17 provided at the inner wall of the cavity 16 to retain the terminal fitting 30 in the cavity 16.

A seal 98 made of a resilient material, such as rubber, is mounted on the wire W behind the barrel 32. The seal 98 is inserted into the mounting portion 15 from behind and at the mounting side MS. Additionally, the seal 98 closely contacts the inner circumferential surface of the mounting portion 15 and the outer circumferential surface of the wire W to provide sealing between these two surfaces. The seal 98 also is fit into the wire insertion hole 55 formed in the rear holder 50, as described in detail later.

A tab insertion opening 13A is formed in the front surface of the tower 13 for permitting the insertion of the male tab 92. More particularly, the tab insertion opening 13A is a slit that extends in the width direction and substantially normal to the forward and backward directions FBD. The front surface of the main portion 31 faces the rear surface of the tab insertion opening 13A. A coupling 23 is formed at the rear end of the tower 13 and projects radially out to be continuous with the rear end of the fitting tube 14. A seal ring 97 made of resilient material, such as rubber, is mounted on the outer circumferential surface of a rear part of the tower 13 before the coupling 23. The seal ring 97 closely contacts the inner circumferential surface of the receptacle 91 and the outer circumferential surface of the tower 13 to provide sealing between these two surfaces when the two housings 10, 90 are connected properly. Windows 18 are formed on the opposite left and right sides of the fitting tube 14 at positions corresponding to the seal ring 97, so that the leading end of the receptacle 91 can be seen through the windows 18 when the two housings 10, 90 are connected properly.

As shown in FIG. 1, the lock arm 12 extends in forward and backward directions FBD at an upper part of the female housing 10. The lock arm 12 is pivotally and resiliently displaceable like a seesaw in and out (up and down) with a center on a support 24 at a position substantially corresponding to the coupling 23. A front part of the lock arm 12 is arranged between the fitting tube 14 and the tower 13, whereas a rear part is exposed above of the mounting portion 15. An operable portion 25 is elevated slightly at the rear of the lock arm 12 and can be pressed for unlocking. An arm accommodating portion 14A bulges out at an upper part of the fitting tube 14 and has a substantially gate-shaped cross section to accommodate the lock arm 12. An operation window 26 is cut out at the rear of the upper wall of the arm accommodating portion 14A and is used to operate the lock arm 12. The operable portion 25 of the lock arm 12 can be operated by a finger or hand of an operator inserted through the operation window 26 for unlocking.

A lock groove 27 extends in forward and backward directions FBD on the lock arm 12 and opens at the rear of the lock arm 12. The lock 95 fits in the lock groove 27 and engages the front end of the lock groove 27 when the housings 10, 90 are connected properly to lock the housings 10, 90 together.

Figure 3:
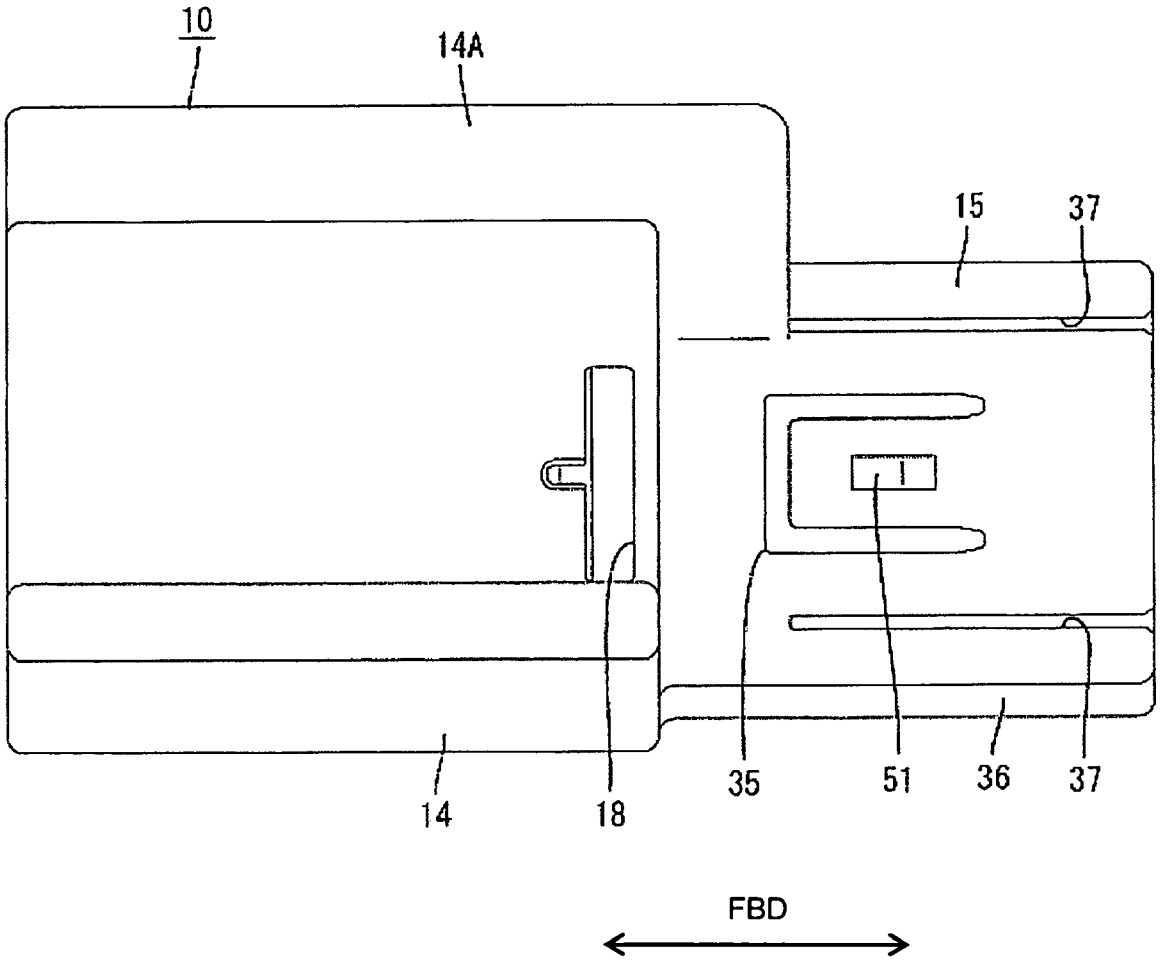
FIG. 3 is a side view of a female housing.

As shown in FIG. 3, left and right interlocking portions 34 project from the outer circumferential surface of the mounting portion 15 at an intermediate part of the mounting portion 15 with respect to forward and backward directions FBD. The interlocking portions 34 are resiliently engageable with locking pieces 51 at the rear holder 50. Rear guiding surfaces of the interlocking portions are sloped out and up towards the front, whereas front locking surfaces are substantially vertical.

U-shaped frames 35 are formed partly around the interlocking portions 34 on the outer circumferential surface of the mounting portion 15. The frames 35 expose only rear areas of the interlocking portions 34 and are arranged along the sides of the locking pieces 51 after the rear holder 50 is mounted. Thus, the frames 35 prevent external matter from deforming the locking pieces 51 inadvertently in a way that could unlock the rear holder 50.

A guiding rib 36 extends in forward and backward directions FBD at the bottom of the outer circumferential surface of the mounting portion 15. Four circumferentially spaced recesses 37 are formed in the outer circumferential surface of the mounting portion 15. The recesses 37 are in the form of dovetail or undercut grooves with cross sections that gradually widened as they get deeper. The recesses 37 are substantially equally spaced in the circumferential direction at intervals of about 90°.

Figure 4:
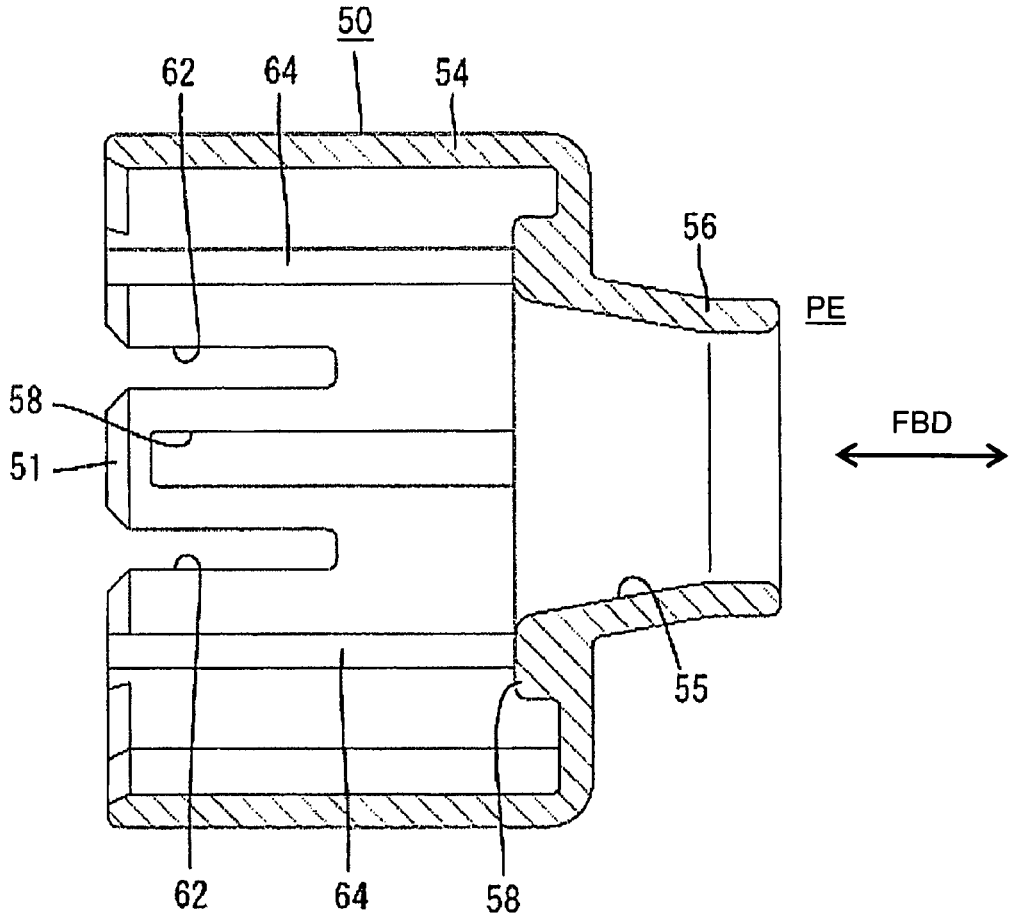
FIG. 4 is a side view in section of a rear holder.
Figure 5:
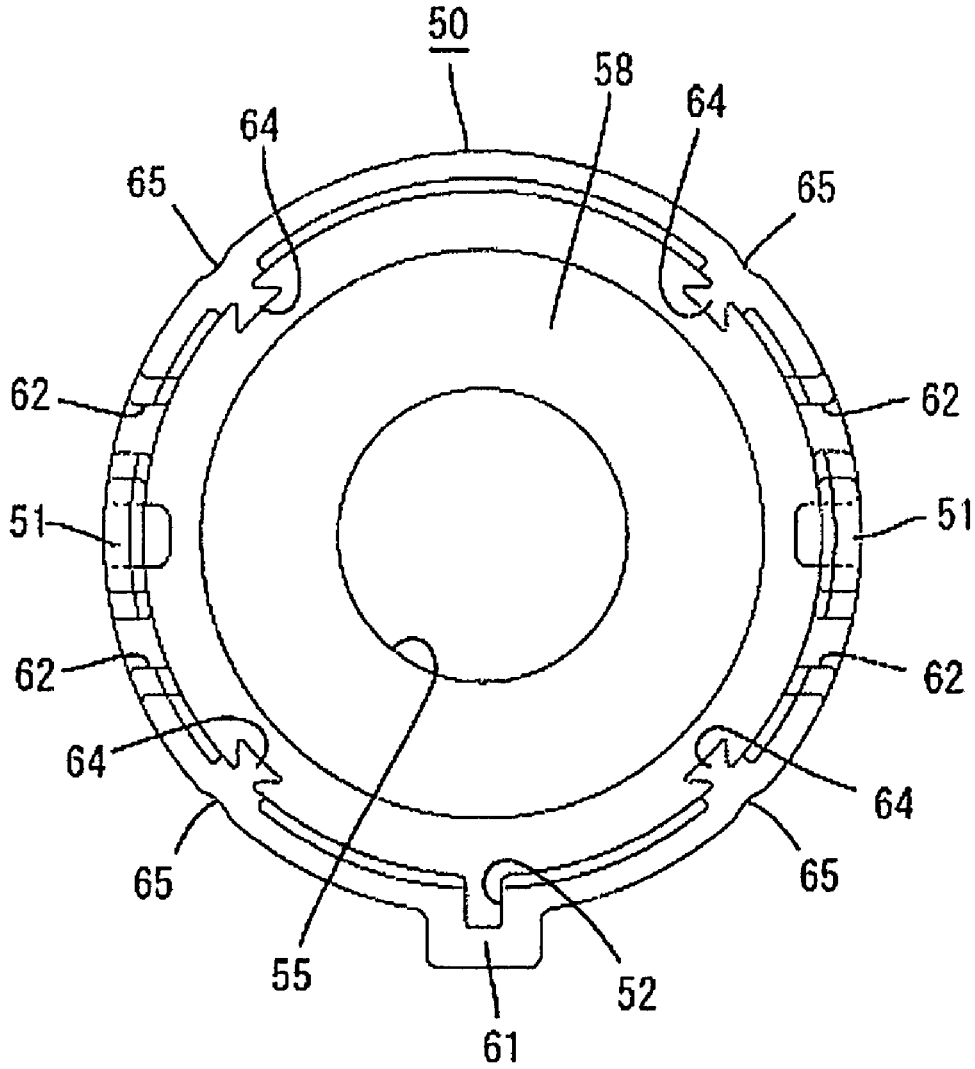
FIG. 5 is a front view of the rear holder.

The rear holder 50 is made e.g. of a synthetic resin and effectively is a cap that is mountable from behind on the mounting side MS of the mounting portion 15, as shown in FIGS. 4 and 5. This rear holder 50 includes a disk-shaped back wall 53 and a substantially cylindrical surrounding wall 54 that projects forward from a peripheral edge of the back wall 53. The surrounding wall 54 fits on the mounting portion 15 and the back wall 53 can substantially close the opening of the mounting portion 15 and can retain the seal 98.

A wire insertion hole 55 is formed substantially in the center of the back wall 53 and can receive the wire W. A truncated conical tube 56 projects back from the back wall 53 and tapers to smaller diameters at farther distances from the back wall 53 and at positions closer to the projecting end PE. The wire insertion hole 55 continues through the tube 56 and communicates with the inner space of the mounting portion 15. A rear part of the seal 98 fits into the wire insertion hole 55 and the tube 56.

Figure 6:
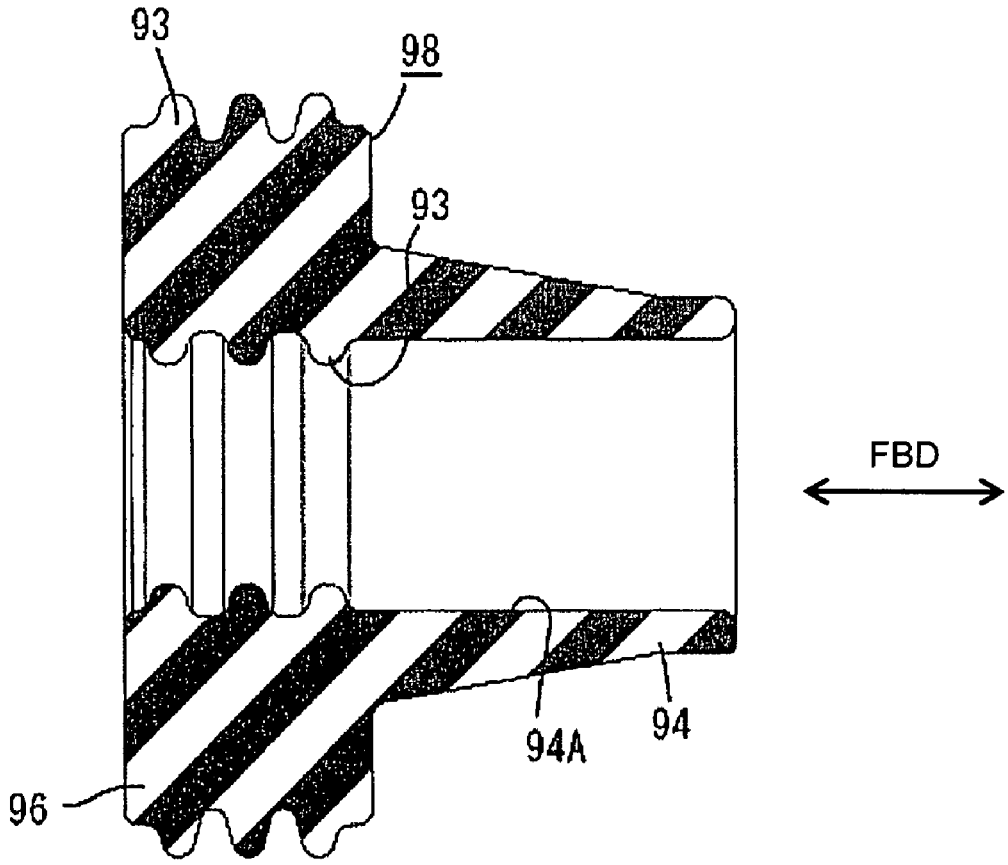
FIG. 6 is a side view in section of a seal.
Figure 7:
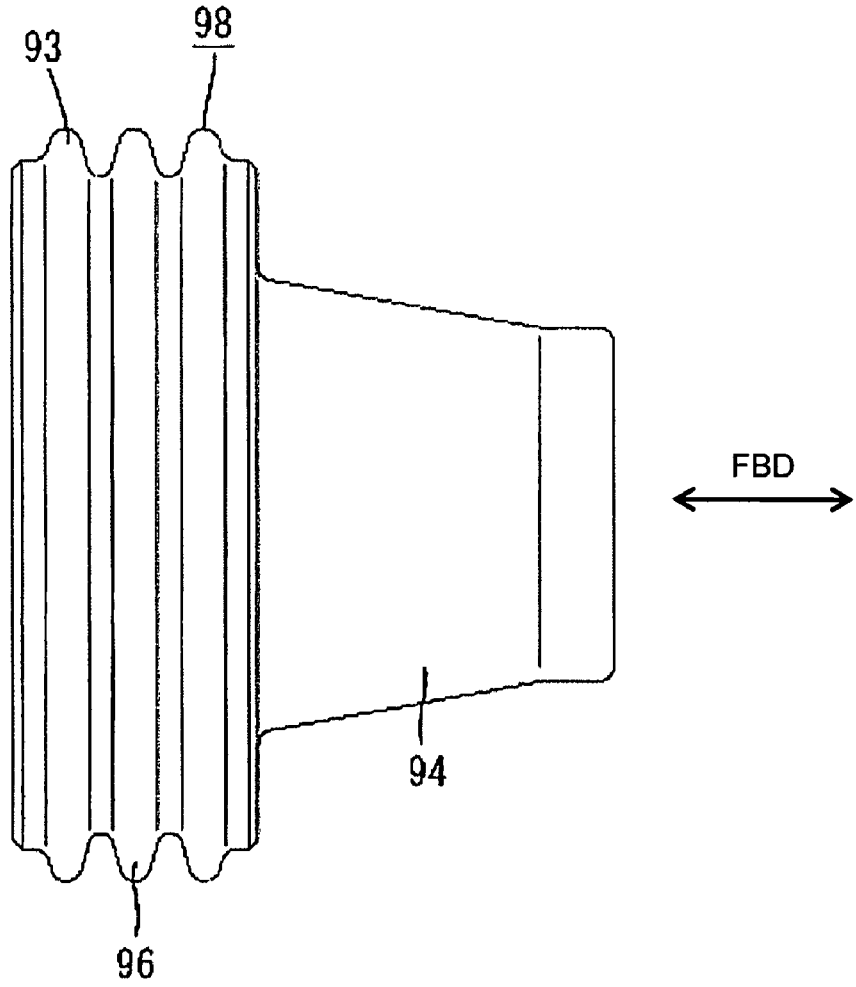
FIG. 7 is a side view of the seal.

The seal 98 is formed unitarily to include a main body 96 and a shake preventing portion 94 that are arranged one after the other in forward and backward directions FBD, as shown in FIGS. 6 and 7. The main body 96 can be fit into the inner space of the mounting portion 15 and has a thickness to substantially fill a space between the outer circumferential surface of the wire W and the inner circumferential surface of the mounting portion 15. Circumferential lips 93 are formed on the inner and outer circumferential surfaces of the main body 96. The lips 93 closely contact the outer circumferential surface of the wire W and the inner circumferential surface of the mounting portion 15 while being compressed in the radial direction when the seal 98 is mounted into the mounting portion 15.

The shake preventing portion 94 projects back from a center part of the rear surface of the main body 96 and is aligned substantially coaxially with the main body 96. Substantially smooth inner and outer circumferential surfaces extend along the shake preventing portion 94, with no lips corresponding to the lips 93 on the main body 96. The inner circumferential surface of the shake preventing portion 94 aligns substantially with portions of the inner circumferential surface of the main body 96 between the lips 93 and is shaped substantially in conformity with the outer circumferential surface of the wire W. The outer circumferential surface of the shake preventing portion 94 has a conical or trunco-conical shape substantially corresponding to the shape of the tube 56. In a natural state, the inner circumferential surface of the shake preventing portion 94 has an inner diameter slightly smaller than the outer diameter of the wire W and the outer circumferential surface thereof has an outer diameter slightly larger than the inner diameter of the tubular portion 56. Accordingly, the shake preventing portion 94 closely contacts the outer circumferential surface of the wire W and the inner circumferential surface of the tube 56 while being compressed between the two surfaces when the seal 98 is mounted into the mounting portion 15. Thus, the wire W in the tubular portion 56 is kept substantially straight in forward and backward directions FBD and will not buckle.

An inner fitting portion 58 project forward from the front surface of the back wall 53 except the outer periphery thereof. The inner fitting portion 58 has an outer peripheral surface substantially concentric with the back wall 53 and an inner peripheral surface continuous with the tube 56. The front surface of the inner fitting portion 58 is substantially flat and substantially normal to the forward and backward directions FBD to achieve substantially surface contact with the rear surface of the seal 98. This inner fitting portion 58 is fit closely into the mounting portion 15 so that the outer circumferential surface of the inner fitting portion closely contacts the inner circumferential surface of the mounting portion 15. A fitting space is defined between the outer circumferential surface of the inner fitting portion 58 and the inner circumferential surface of the mounting portion 15 and receives a rear edge of the mounting portion 15.

A bulge 61 of U-shaped cross section projects radially out at bottom part of the surrounding wall 54, and a guidable groove 52 extends in forward and backward directions FBD in the bulge 61. The guiding rib 36 engages in the guidable groove 52 of the bulge 61 to guide the mounting of the rear holder 50 into the mounting portion 15 and to prevent rotation of the rear holder 50 about its central axis CA. The bulge 61 interferes with the rear opening edge of the mounting portion 15 if an attempt is made to mount the rear holder 50 in an improper posture and prevents further mounting. Thus, the improper posture of the rear holder 50 can be recognized at the start of the mounting operation of the rear holder 50.

The locking pieces 51 are formed at the left and right sides of the surrounding wall 54 for engaging the respective interlocking portions 34 of the mounting portion 15 Each locking piece 51 is a substantially U-shaped frame that is resiliently deformable in and out between a pair of slits 62 that extend back from the front end of the surrounding wall 54. Each locking piece 51 has a locking groove that is open at the rear end of the locking piece 51, but closed at the front end of the locking piece 51. The front ends of the locking pieces 51 move onto the interlocking portions 34 in the process of mounting the rear holder 50 on the mounting portion 15 and deform the locking pieces 51. The interlocking portions 34 enter the locking grooves 63 when the rear holder 50 is properly mounted and the locking pieces 51 resiliently restore. Thus, the rear holder 50 is locked on the mounting portion 15.

As shown in FIG. 5, four ribs 64 are formed on the inner circumferential surface of the surrounding wall 64. Each rib 64 has an isosceles trapezoidal or undercut cross section that gradually widens from the base end toward the leading end. The four ribs 64 are spaced substantially equally apart at circumferential intervals of about 90°. The ribs 64 are at positions substantially corresponding to the recesses 37 when the rear holder 50 is opposed to the mounting portion 15 and are engageable with the dovetail recesses 37 to lock the ribs 64 and the recesses 37 in radial directions.

Recessed grooves 65 are formed on the outer circumferential surface of the surrounding wall 54 at positions aligned radially with the ribs 64, so that the grooves 65 and the ribs 64 are back-to-back. The recessed grooves 65 have a shallow arcuate cross section and extend substantially in forward and backward directions FBD along substantially along the entire length of the surrounding wall 54.

To assemble the connector, the terminal fitting 30 connected with the end of the wire W is inserted into the cavity 16 of the female housing 10. The terminal fitting 30 enters the tower 13 from the mounting portion 15 and is locked by the resilient lock 17 in the tower 13.

Then, the seal 98 mounted on the end of the wire W is fit and held in the mounting portion 15, and the rear holder 50 having the wire W inserted through the wire insertion hole 55 is mounted from behind on the outer circumferential surface of the mounting portion 15. At this time, the guiding rib 36 of the mounting portion 15 is inserted into the entrance of the guidable groove 52 of the rear holder 50, and the ribs 64 of the rear holder 50 are inserted into the respective entrances of the recesses 37 of the mounting portion 15. The ribs 64 are positioned precisely with respect to the recesses 37 and engaged therewith by aligning the recessed grooves 65 on the outer circumferential surface of the rear holder 50 with the mating recesses 37. The rear holder 50 is pushed forward in this state along the recesses 37. Thus, the frames 35 of the mounting portion 15 enter the slits 62 of the surrounding wall 54 and the leading ends of the locking pieces 51 slide along the guiding surfaces of the interlocking portions 34 to deform the locking pieces 51. The inner fitting portion 58 of the back wall 53 fits into the rear opening edge of the mounting portion 15 when the rear holder 50 is mounted on the mounting portion 15 to a proper depth and retains the seal 98 in the mounting portion 15. Additionally, the interlocking portions 34 are fit into the locking grooves 63 as the locking pieces 51 resiliently restore. The locking pieces 51 engage the locking surfaces of the interlocking portions 34 in a detaching direction of the rear holder 50 to retain the rear holder 50 reliably. The rear holder 50 that has been mounted properly mounted on the mounting portion 15 is held in close contact with the outer circumferential surface of the seal 98 from the inner surface of the back wall 53 to the inner surface of the tube 56.

Next, the tower 13 is fit into the receptacle 91 of the mating male housing 90. The lock arm 12 engages the lock 95 when the female and male housing 10, 90 are connected properly to lock the housings 10, 90 into each other. Further, the male tab 92 is inserted to a proper depth in the main portion 31 of the terminal fitting 30 when the housings 10, 90 are connected properly to connect the terminal fittings 30, 92. Additionally, the inner circumferential surface of the receptacle 91 closely contacts the outer circumferential surface of the seal ring 97 to provide sealing between the two housings 10, 90.

The wire W drawn out from the female housing 10 may be shaken in a direction intersecting the forward and backward directions FBD after the two housings 10, 90 are connected. However, the wire W cannot shake in the mounting portion 15. Additionally, the terminal fitting 30 connected with the end of this wire W is not shaken, since the wire W is held by the shake preventing portion 94 of the seal 98 at a position corresponding to the tubular portion 56 of the rear holder 50 and cannot make loose movements.

As described above, even if the wire W drawn out from the female housing 10 is shaken when the female and male housings 10, 90 are connected properly, the shakes of the wire W and the terminal fitting 30 in the female housing 10 are suppressed by the close contact of the shake preventing portion 94 of the seal 98 mounted on the wire W with the outer circumferential surface of the wire W and the inner circumferential surface of the wire insertion hole 55. Therefore the connected positions of the two terminal fittings 30, 92 are kept constant to improve connection reliability.

The clearance between the wire insertion hole 55 and the wire W is filled by the seal 98. Thus, the connector accommodates a deviation of positional precision that can be created between the wire insertion hole 55 and the wire W. The connector distinguishes in this regard from prior art connectors where the outer circumferential surface of the wire W is held directly in close contact with the inner circumferential surface of the wire insertion hole. More particularly, the inner circumferential surface of the wire insertion hole and the outer circumferential surface of the wire of prior art connectors cannot be kept in close contact if the diameter of the wire insertion hole and the outer diameter of the wire deviate from specified values due to dimensional errors. However, according to this embodiment, dimensional errors of the diameter of the wire insertion hole 55 and the outer diameter of the wire W can be absorbed by interposing the resiliently compressible seal 98 between the wire insertion hole 55 and the wire W. Therefore the inner circumferential surface of the wire insertion hole 55 and the outer circumferential surface of the wire W can be kept in close contact.

The shake preventing portion 94 is held in close contact with the inner circumferential surface of the wire insertion hole 55 in the tube 56, and the wire W is held in contact with the tube 56 over the entire length of the tube 56. Therefore shake of the wire W in the female housing 10 is suppressed reliably.

The inner circumferential surface of the wire insertion hole 55 in the tube 56 is tapered toward the back and the outer circumferential surface of the shake preventing portion 94 is tapered substantially in conformity with the inner circumferential surface of the wire insertion hole 55. The wire W drawn out through the wire insertion hole 55 may be shaken. However, a shake supporting part is held closely by the shake preventing portion 94 to suppress the shaking movement. Accordingly, a shaking force of the wire W is less likely to be transmitted to the connected portions of the both terminal fittings 30, 92, and connection reliability is improved further.

Figure 8:
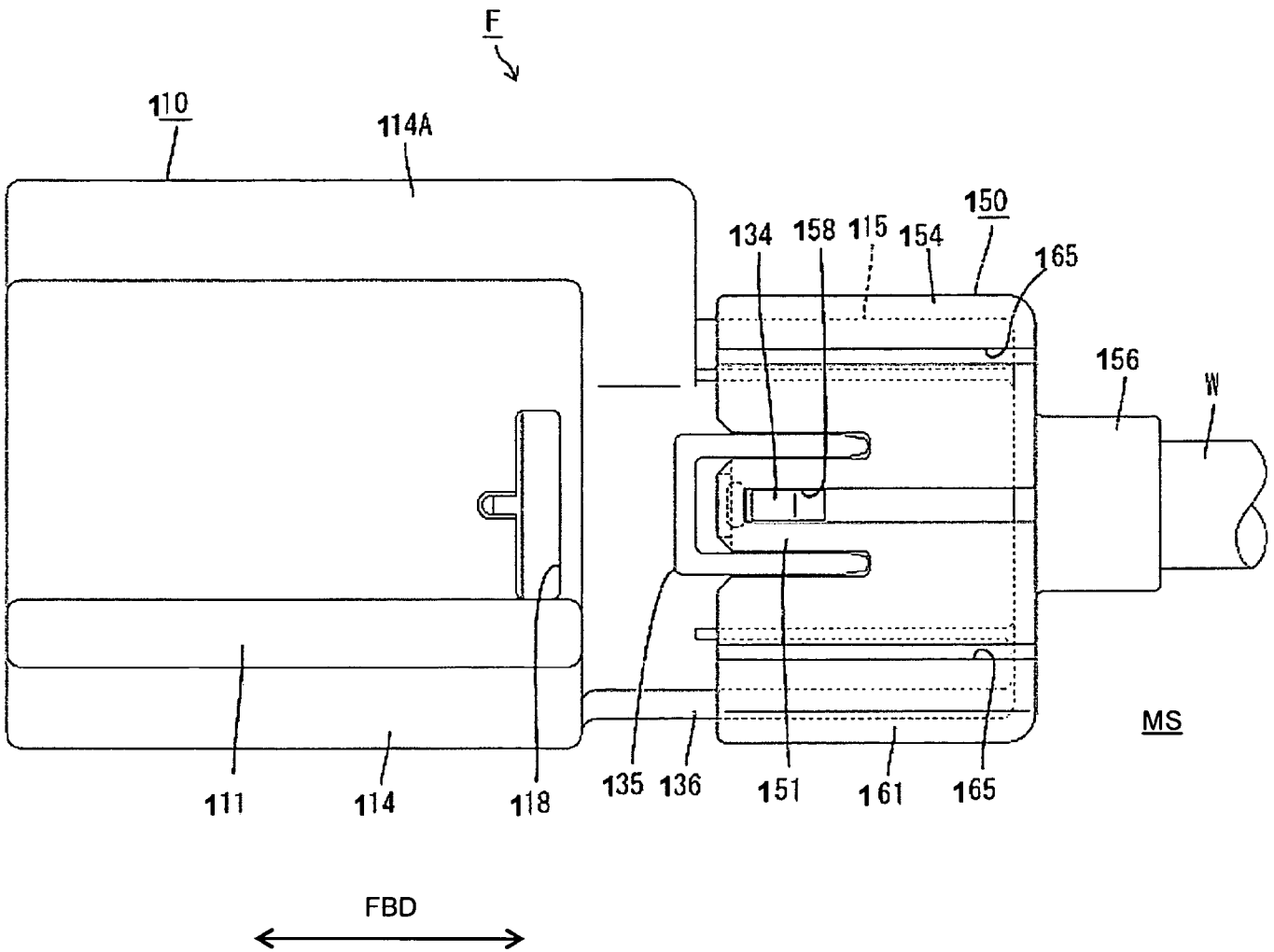
FIG. 8 is a side view of a connector according to a second embodiment.

A connector according to a second embodiment of the invention is identified by the letter F in FIGS. 8 to 21. The connector F has a female housing 110 for accommodating a female terminal fitting 130 and a rear holder 150 to be mounted on the female housing 110 from a mounting side MS. The female housing 110 is connectable with a mating male housing 190. The connector F also has a detector 199 for detecting a connected state of the female and male housings 110, 190. In the following description, ends of the female and male housings 110, 190 to be connected are referred to as the front ends concerning forward and backward directions FBD and reference is made to FIG. 8 concerning the vertical direction.

Figure 21:
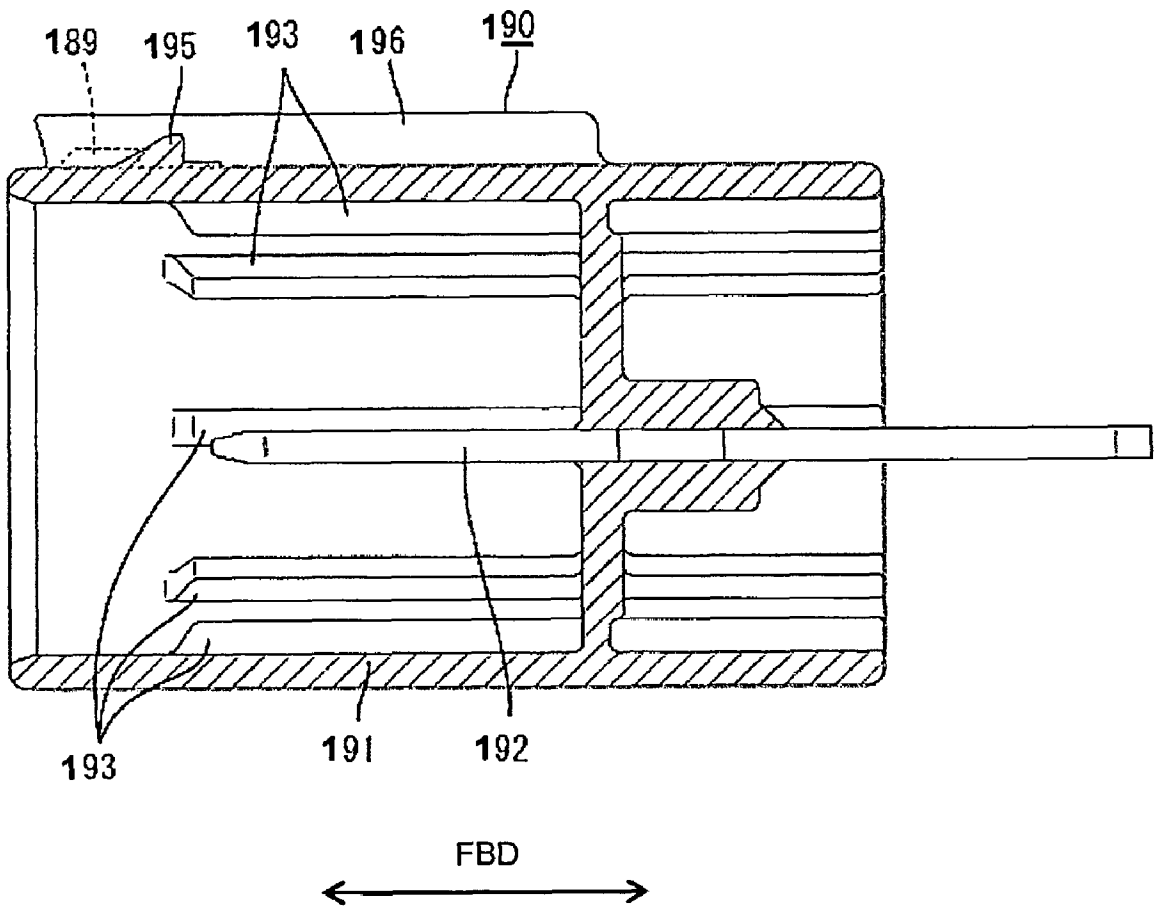
FIG. 21 is a side view in section of a male housing.

The mating male housing 190 is made of a synthetic resin and includes a round tubular receptacle 191 with an open front end, as shown in FIG. 21. A male tab 192 is mounted through the back wall of the receptacle 191 and projects into the receptacle 191. The male tab 192 is a plate made of an electrically conductive material, such as metal, and has a plate surface aligned along forward and backward directions FBD. Eight ribs 193 are formed on the inner circumferential surface of the receptacle 191 and extend in forward and backward directions FBD at positions spaced circumferentially at intervals of about 45°. The ribs 193 have substantially identical rectangular cross sections and substantially the same length in forward and backward directions FBD. Additionally, the ribs 193 extend from the back end of the receptacle 191 to a position slightly behind the front edge of the receptacle 191.

Figure 20:
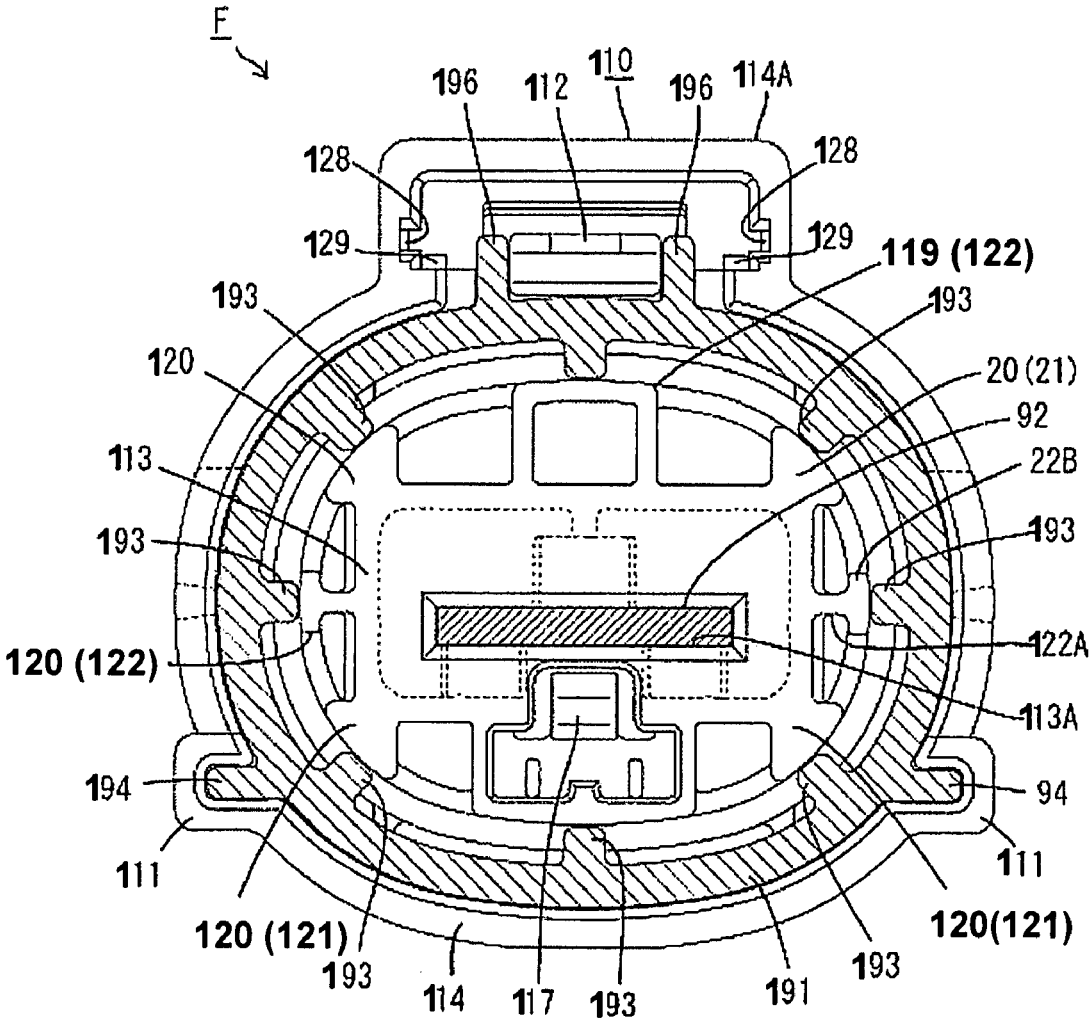
FIG. 20 is a vertical section of an essential portion of the connector showing the state where the tower is fit in the receptacle.

As shown in FIG. 20, left and right guide ribs 194 bulge out sideways from bottom parts of the opposite lateral sides of the outer surface of the receptacle 191 and extend in substantially forward and backward directions FBD. A lock 195 projects at an upper portion of the outer circumferential surface of the receptacle 191. The lock 195 is engageable with a lock arm 112 of the female housing 110. Left and right protection walls 196 project out from the outer circumferential surface of the receptacle 191 at opposite sides of the lock 195 and extend in substantially forward and backward directions FBD. The protection walls 196 protect the lock 195 and are arranged at opposite sides of the lock arm 112 when the two housings 110, 190 are connected. Left and right unlocking portions 189 project unitarily out from the front ends of the outer sides of the protection walls 196. The unlocking portions 189 interfere with the detector 199 assembled into the female housing 110 when the housings 110, 190 are connected properly to cancel a state of the detector 199 locked into the female housing 110.

The female housing 110 is made e.g. of a synthetic resin and has opposite front and rear ends. A tower 113 is formed at the front end and can be fit into the mating receptacle 191. A tube 114 surrounds the tower 113 and is spaced out from the tower 113 sufficiently for the receptacle 191 to be inserted therebetween. A mounting portion 115 extends unitarily back from the tower 113 and the rear holder 150 can be mounted on the mounting portion 115 from the rear or mounting side MS. Guides 111 bulge out sideways at the bottom left and right parts of the tube 114 and extend over substantially the entire length in forward and backward directions FBD. The guides 111 can receive the guide ribs 194 of the receptacle 191 from the front to guide the connecting operation of the two housings 110, 190. The mounting portion 115 has a round tubular shape, and is larger than the tower 113 but smaller than the tube 114. A cavity 116 penetrates the tower 113 in forward and backward directions FBD and communicates with the inner space of the mounting portion 115. A terminal fitting 130 is insertable through the inner space of the mounting portion 115 and into the cavity 116.

The terminal fitting 130 has a box-shaped main portion 131 and a barrel 132 that is continuous with the rear end of the main portion 131. The main portion 131 is configured to fit in the cavity 116 of the tower 113 without loose movement and further is configured to receive the male terminal fitting. The barrel 132 is configured to be crimped, bent or folded into connection with an exposed core at the end of a wire W and is arranged in the inner space of the tube 114. A seal 198 made of resilient material, such as rubber, is mounted on the wire W behind the barrel 132 and is inserted into the mounting portion 115 from the rear or mounting side MS. Thus, the seal 198 closely contacts the inner circumferential surface of the mounting portion 115 and the outer circumferential surface of the wire W to provide sealing between these two surfaces. The main portion 131 is formed with a locking hole 133 for receiving a lock 117 on the inner wall of the cavity 116 to retain the terminal fitting 130 in the cavity 116.

A tab insertion opening 113A is formed in the front surface of the tower 113 for receiving the male tab 192. The tab insertion opening 113A is slit extending in the width direction and the front surface of the main portion 131 faces the tab insertion opening 113A. A seal ring 197 made of resilient material, such as rubber, is mounted on the rear part of the outer circumferential surface of the tower 113. The seal ring 197 closely contacts the inner circumferential surface of the receptacle 191 and the outer circumferential surface of the tower 113 to provide sealing between these two surfaces when the two housings 110, 190 are connected properly. Windows 118 are formed on the opposite left and right sides of the tube 114 at positions corresponding to the seal ring 197, so that the leading end of the receptacle 191 can be seen through the windows 118 when the two housings 110, 190 are connected properly.

Rib receiving potions 119 are circumferentially spaced on the outer surface of the tower 113 and extend in forward and backward directions FBD. The respective rib receiving portions 119 are arranged to face the ribs 193 on the inner circumferential surface of the receptacle 191 so that their projecting end surfaces contact when the two housings 110, 190 are connected. As shown in FIG. 20, the rib receiving portions 119 include irregularly-shaped ribs 120 with projecting ends that are wider than the base ends.

The irregularly-shaped ribs 120 are arranged substantially symmetrically on the left and right surfaces of the tower 113 with respect to a central axis. The irregularly shaped ribs 120 at the opposite ends of the side surfaces in height direction are dovetail ribs 121 having an undercut cross section and those located in the middle of the side surfaces in height direction are substantially T-shaped ribs 122 having a T-shaped cross section. The projecting end surfaces of both the dovetail ribs 121 and the T-shaped ribs 122 have arcuate shapes extending substantially along an imaginary arc concentric with the inner circumferential surface of the tube 114. Clearances defined between the dovetail ribs 121 and the T-shaped ribs 122 are mold removal spaces formed by removing pins during molding.

Each T-shaped rib 122 includes a supporting strut 122A that bulges radially out to the outer circumferential surface of the tower 113 and a receiving base 122B extending substantially normal to an extending direction of the supporting strut 122A. The T-shaped ribs 122 extend from the front end of the tower 113 to an intermediate position in forward and backward directions FBD. The rear ends of the T-shaped rib 122 are slightly before or adjacent to the front end of the seal 198. The receiving base 122B can support the mating rib 193 over the substantially entire formation range thereof so and absorbs displacement of the rib 193 within this formation range.

Figure 17:
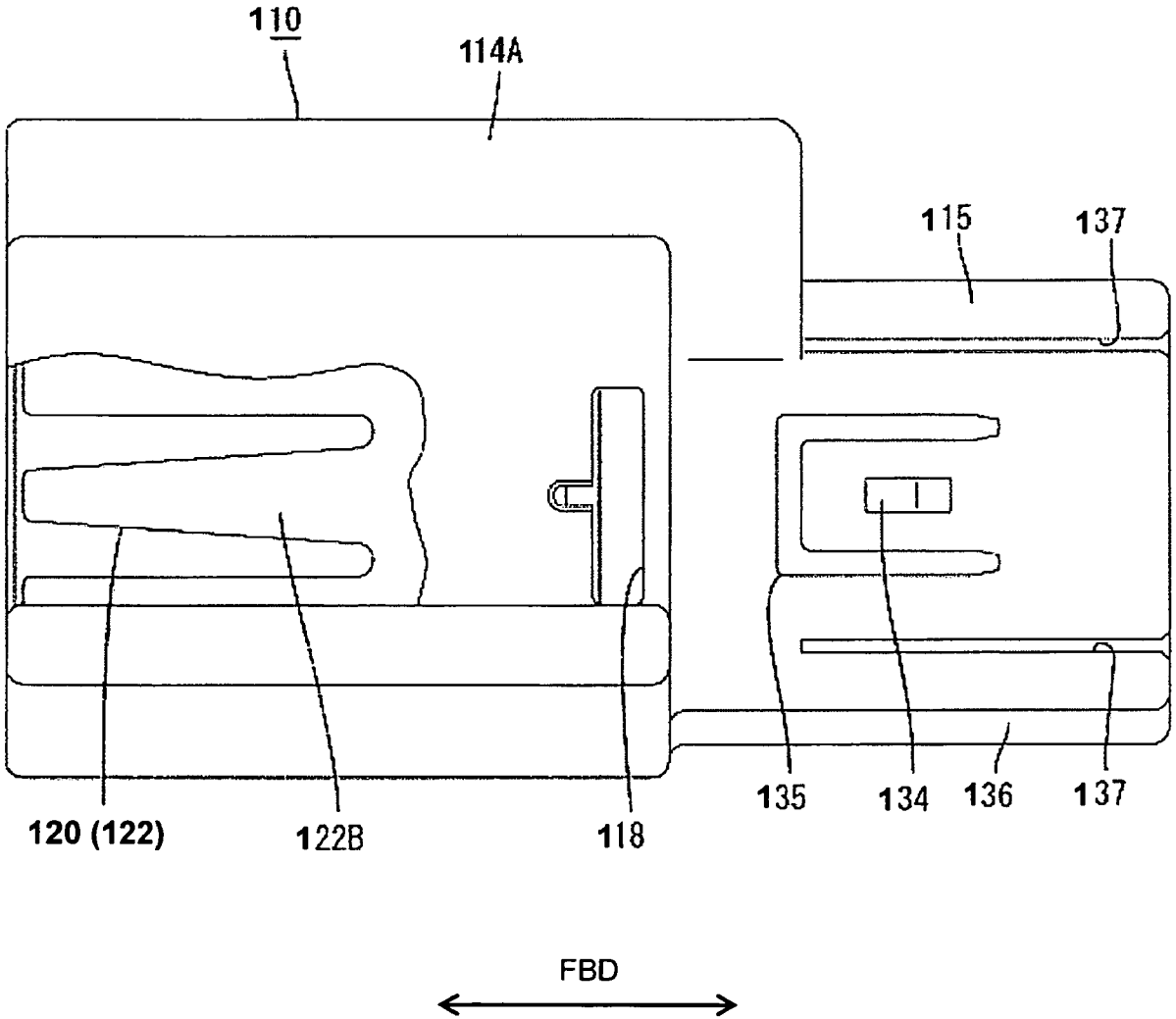
FIG. 17 is a side view partly in section showing an essential portion of the female housing.
Figure 18:
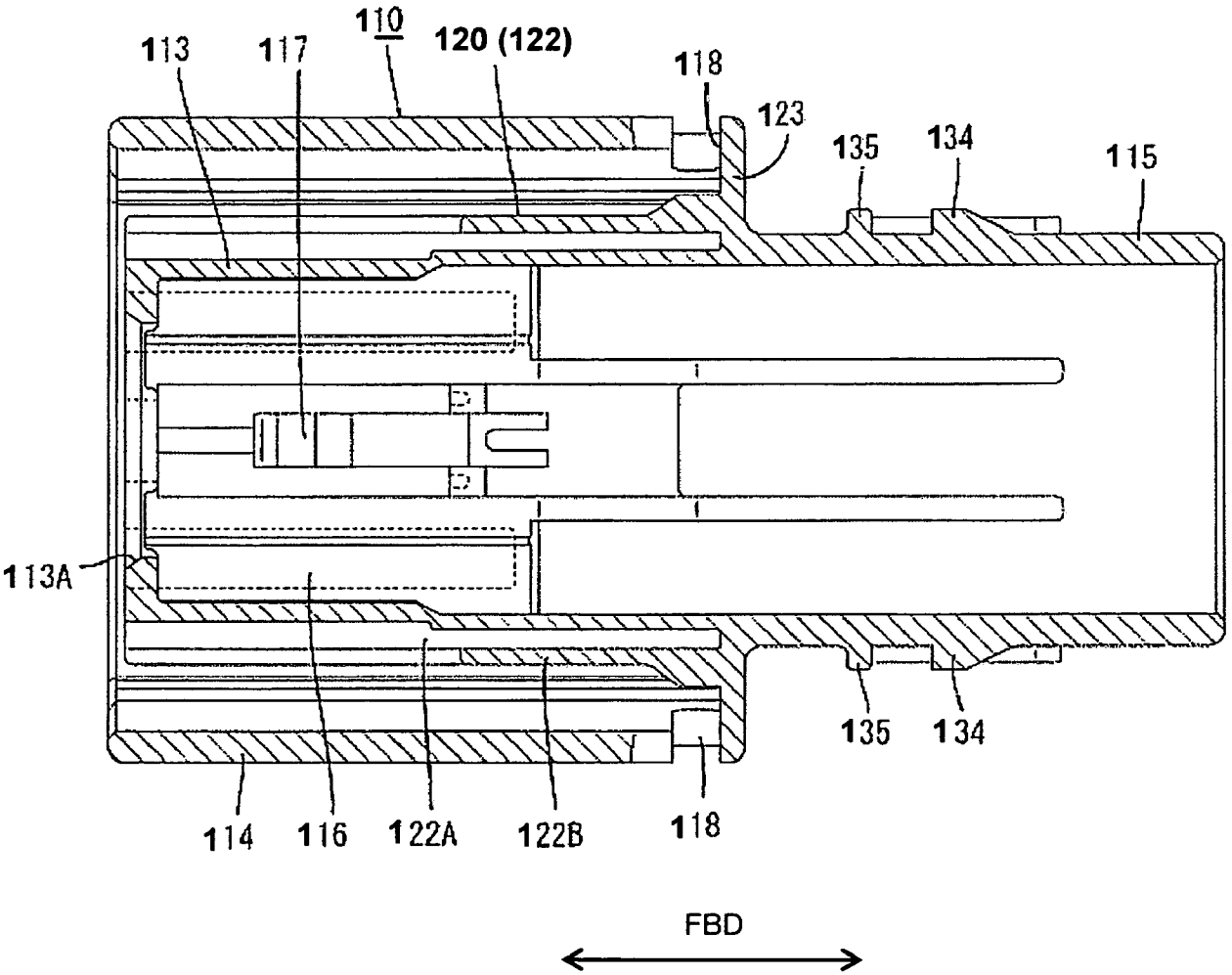
FIG. 18 is a horizontal section of the female housing.
Figure 19:
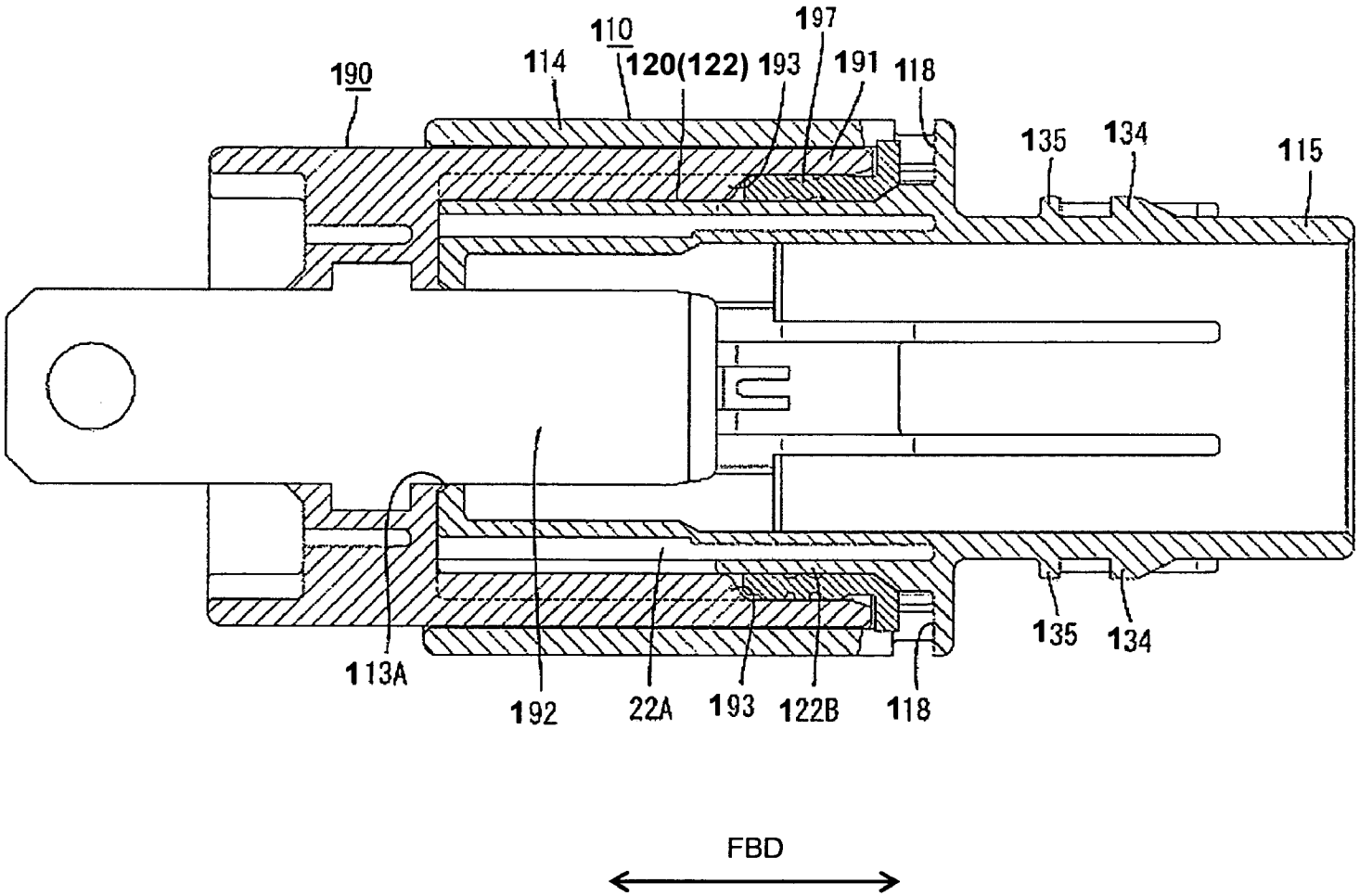
FIG. 19 is a horizontal section of the connector showing a state where a tower is fitted in a receptacle.

As shown in FIG. 17, each receiving base 122B is gradually widened from the front end towards the rear end to narrow the clearances to the dovetail ribs 121 towards the back side. The rib receiving portions 119 except the irregularly shaped ribs 120 are arranged on the upper and lower surfaces of the tower 113 and are bored inside to have a tunnel-shaped cross section. Out of these tunnel-shaped ribs, the inside of the tunnel-shaped rib on the lower surface of the tower 113 is part of a mold removal space formed as the lock 117 is formed. Further, a coupling portion 123 bulges radially out at the rear end of the tower 113 so as to be continuous with the rear end of the tube 114.

Figure 9:
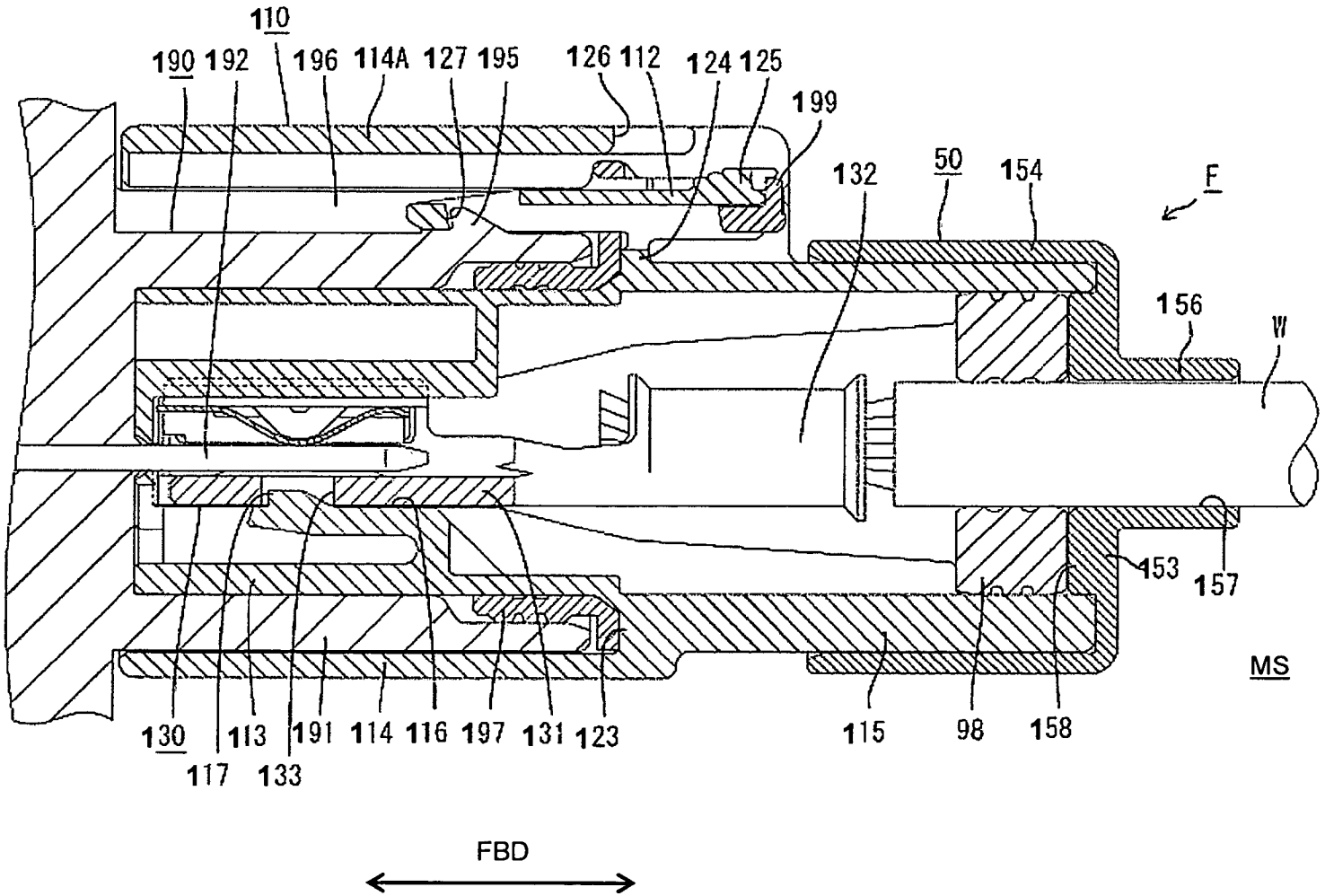
FIG. 9 is a side view in section of the connector in a connected state.

As shown in FIG. 9, the lock arm 112 extends in forward and backward directions FBD at an upper part of the female housing 110. The lock arm 112 is resilient and is pivotally displaceable like a seesaw up and down or towards and away the housing with a center on a support 124 provided at a position substantially corresponding to the coupling 123. A front portion of the lock arm 112 is arranged between the tube 114 and the tower 113, whereas a rear portion thereof is exposed above the mounting portion 115. An operable portion 125 is slightly elevated at the rear end of the lock arm 112 and can be pressed for unlocking. An arm accommodating portion 114A bulges at an upper part of the tube 114 to have an inverted U-shaped cross section, and the lock arm 112 is arranged inside the arm accommodating portion 114A. A rear part of the arm accommodating portion 114A is continuous with the upper surface of the mounting portion 115, and an operation window 126 is cut out in the upper wall of the arm accommodating portion 114A. The operable portion 125 of the lock arm 112 is operated by a finger or hand of an operator inserted through the operation window hole 126 for unlocking.

A lock groove 127 extends in forward and backward directions FBD along the lock arm 11 and is open at the rear end of the lock arm 112. The lock 195 fits into the lock groove 127 when the two housings 110, 190 are connected properly and engages the front end of the lock groove 127 to lock the housings 110, 190 together. The detector 199 is fit into the lock groove 127 of the lock arm 112 from behind. The detector 199 is displaceable between a push-in preventing position where the detector 199 is engaged partly with the lock groove 127 and a detecting position reached by pushing the detector 199 forward from the push-in preventing position for proper engagement with the lock groove 127. Rail grooves 128 extend in forward and backward directions FBD in the inner surfaces of the opposite side walls of the arm accommodating portion 114A, and stoppers 129 engageable with left and right legs 199A on the detector 199 are formed at intermediate positions of the rail grooves 128 with respect to the length direction. The stoppers 129 engage the legs 199A to hold the detector 199 at the push-in preventing position. The unlocking portions 189 of the receptacle 191 interfere with the leading ends of the legs 199A as the two housings 110, 190 are connected properly, and lift the legs 199A out and up. Thus, the legs 199A and the stoppers 129 disengage and permit the detector 199 to be pushed to the detecting position. Accordingly, an operator knows that the two housings 110, 190 are connected properly if the detector 199 can be pushed and knows that the housings 110, 190 are connected only partly if the detector 199 cannot be pushed in.

Left and right interlocking portions 134 project from an intermediate part the outer circumferential surface of the mounting portion 115 with respect to forward and backward directions FBD. The interlocking portions 134 are resiliently engageable with respective locking pieces 151 at the rear holder 150. An inclined guide surface is defined on the rear of each interlocking portion 134 and a vertical locking surface is defined on the front end of each interlocking portion 134.

Figure 10:
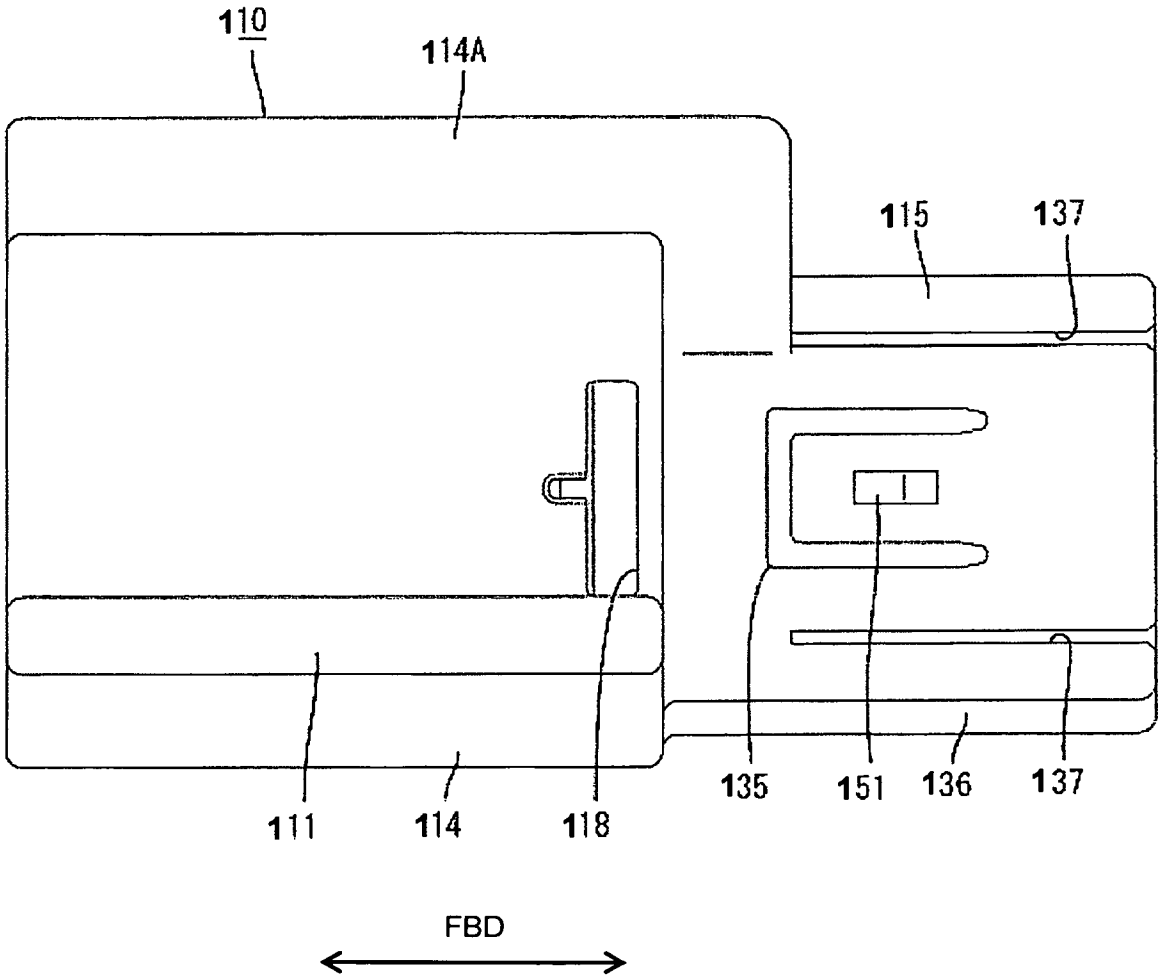
FIG. 10 is a side view of a female housing.

U-shaped frames 135 are formed on the outer circumferential surface of the mounting portion 115 and around all but the ends of the interlocking portions 134, as shown in FIG. 10. The frames 135 are arranged along the side edges of the locking pieces 151 after the rear holder 150 is mounted, and prevent the locking pieces 151 from being inadvertently deformed by external matter.

Figure 11:
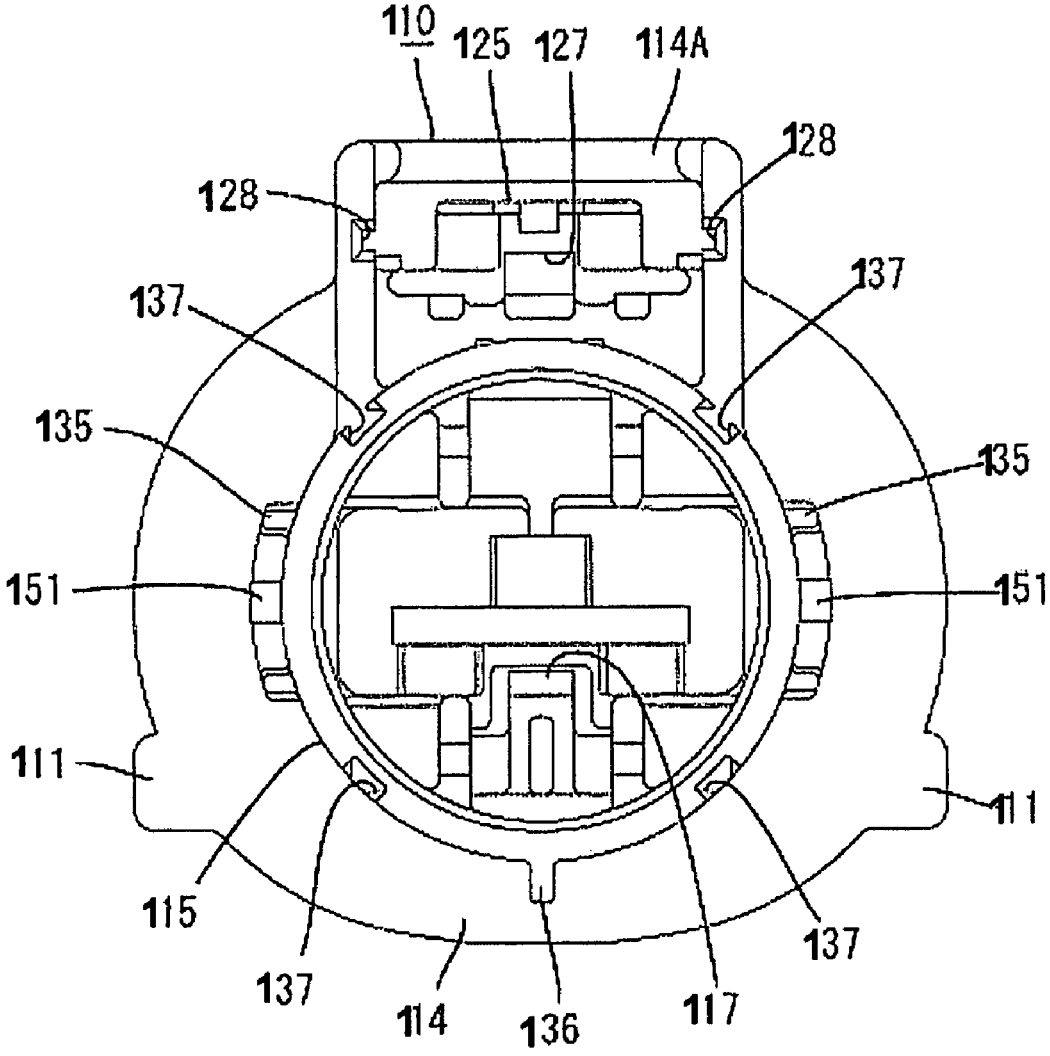
FIG. 11 is a rear view of the female housing.
Figure 12:
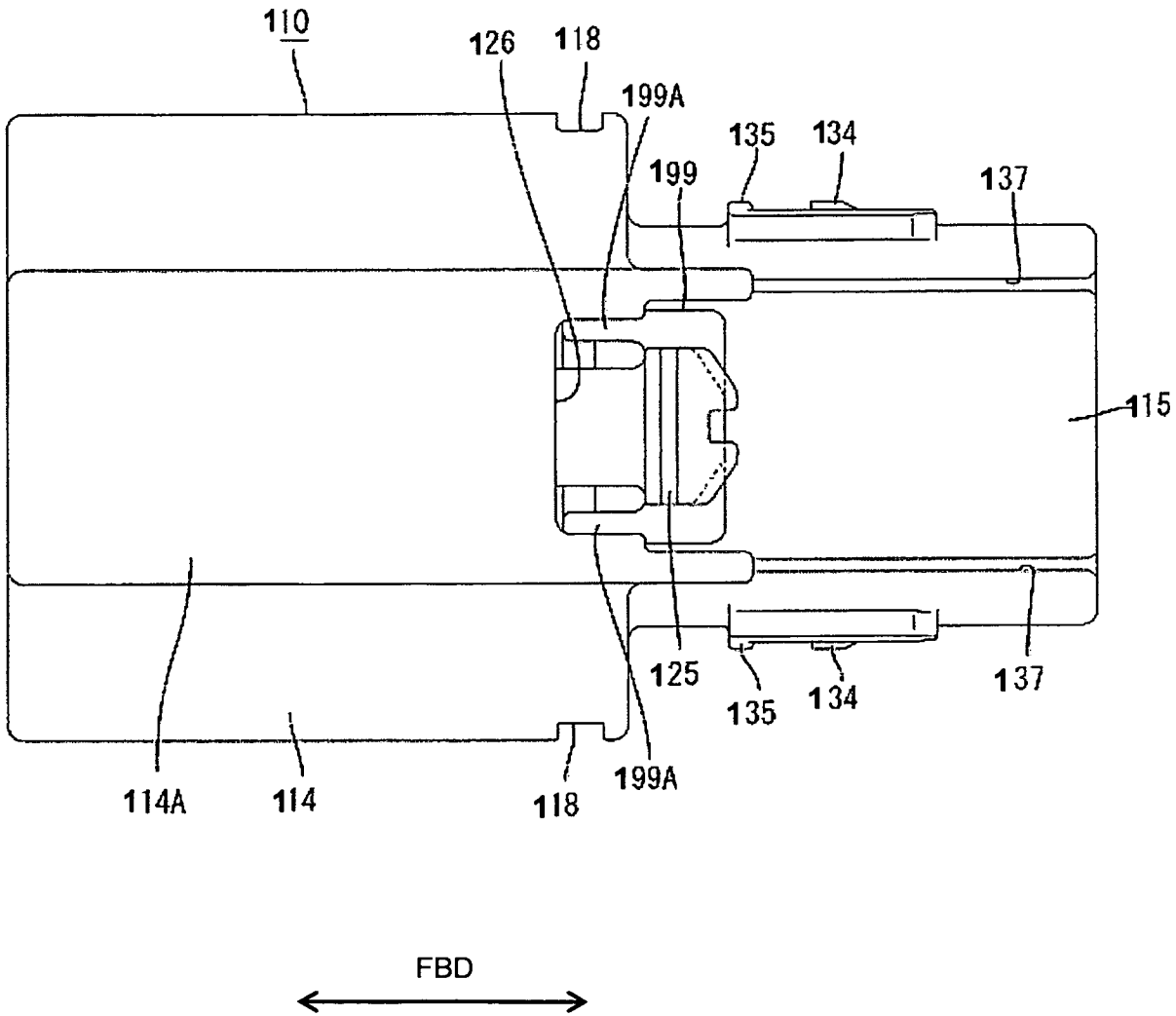
FIG. 12 is a plan view of the female housing.
Figure 13:
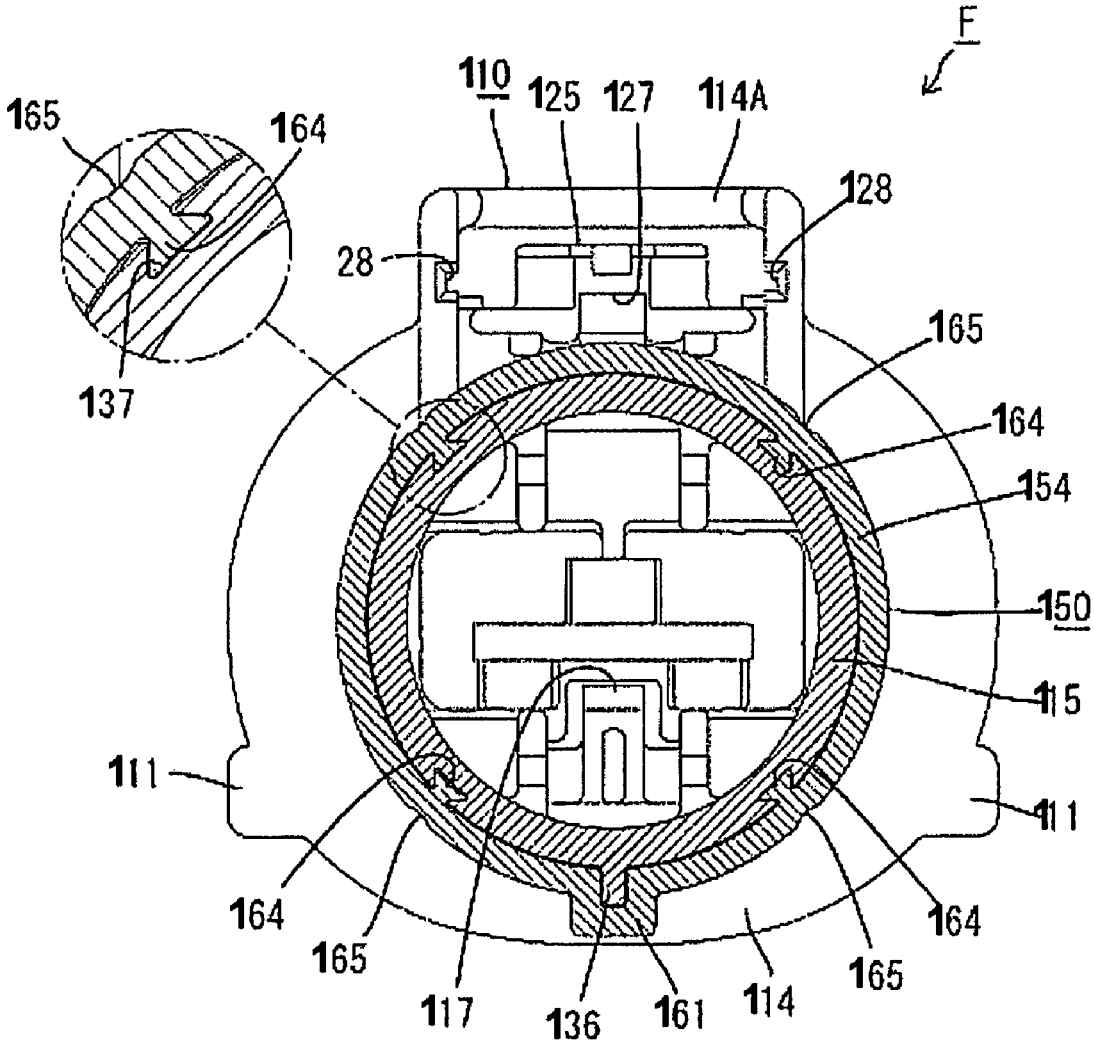
FIG. 13 is a vertical section of an essential portion of the connector showing a state where a rear holder is mounted on a mounting portion.

A guiding rib 136 extends in forward and backward directions FBD at the bottom end of the outer circumferential surface of the mounting portion 115, and is engageable with a guidable groove 152 in the rear holder 150. As shown in FIG. 11, four circumferentially spaced recesses 137 are formed in the outer circumferential surface of the mounting portion 115. The recesses 137 are dovetail or undercut grooves with cross sections that gradually widened as they get deeper. The four recesses 137 are equally spaced at circumferential intervals of about 90° and extend substantially in forward and backward directions FBD. The rear ends of the recesses are exposed at the open rear end of the mounting portion 115 and the front ends thereof are at the same position as the rear end of the arm accommodating portion 114A of the tube 114 with respect to forward and backward directions FBD. The left and right upper recesses 137 are continuous with the base ends of the opposite side walls of the arm accommodating portion 114A.

Figure 14:
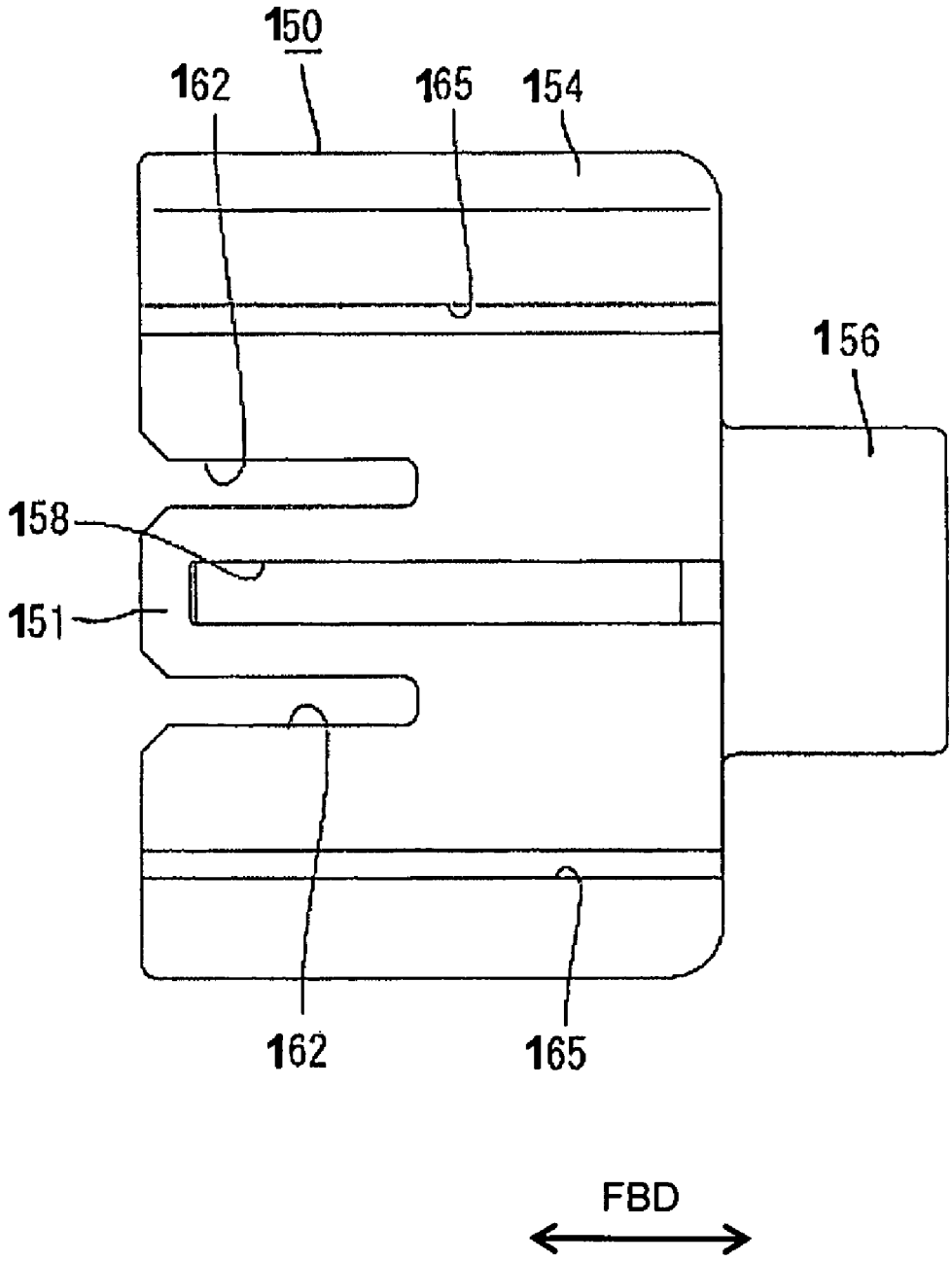
FIG. 14 is a side view of the rear holder.
Figure 15:
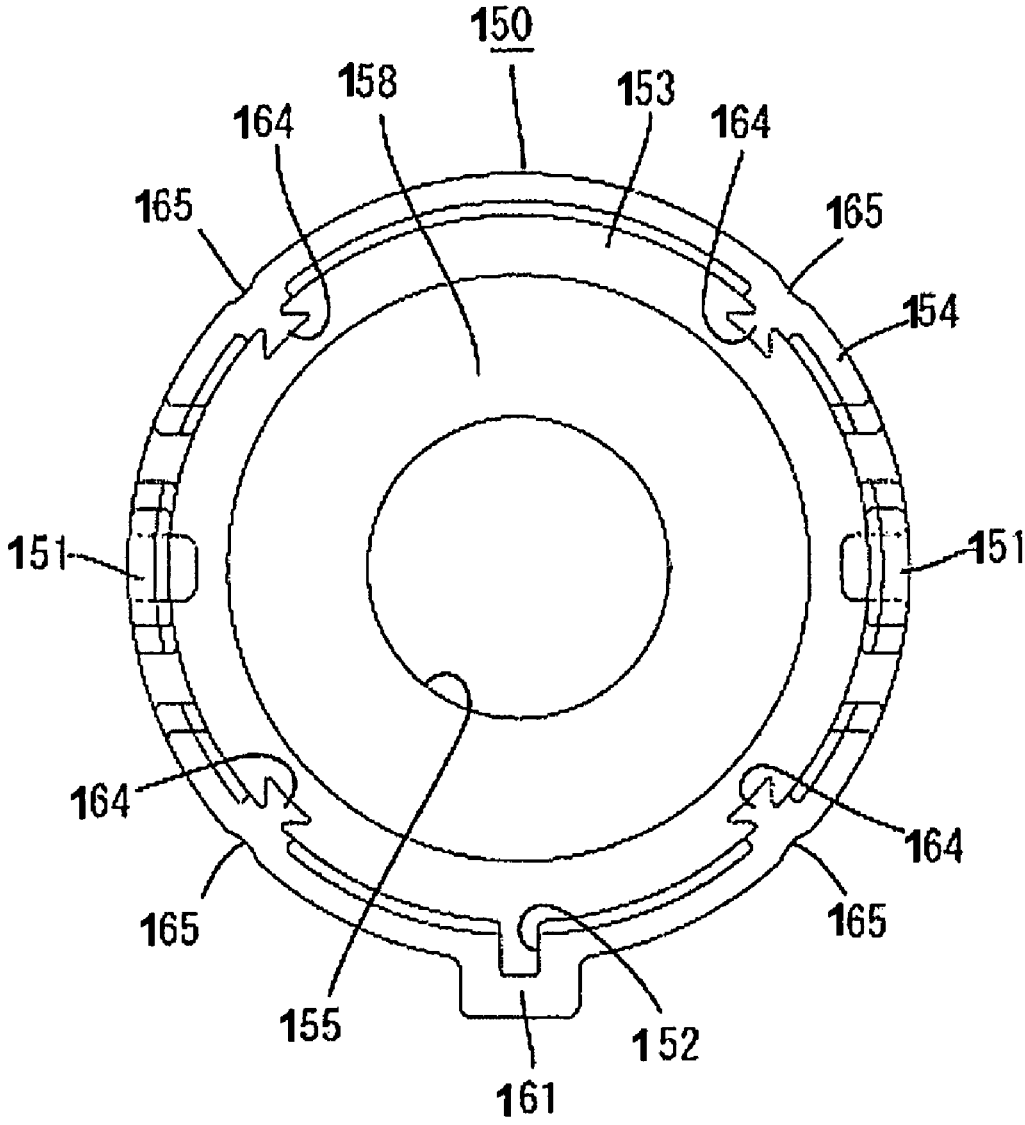
FIG. 15 is a front view of the rear holder.
Figure 16:
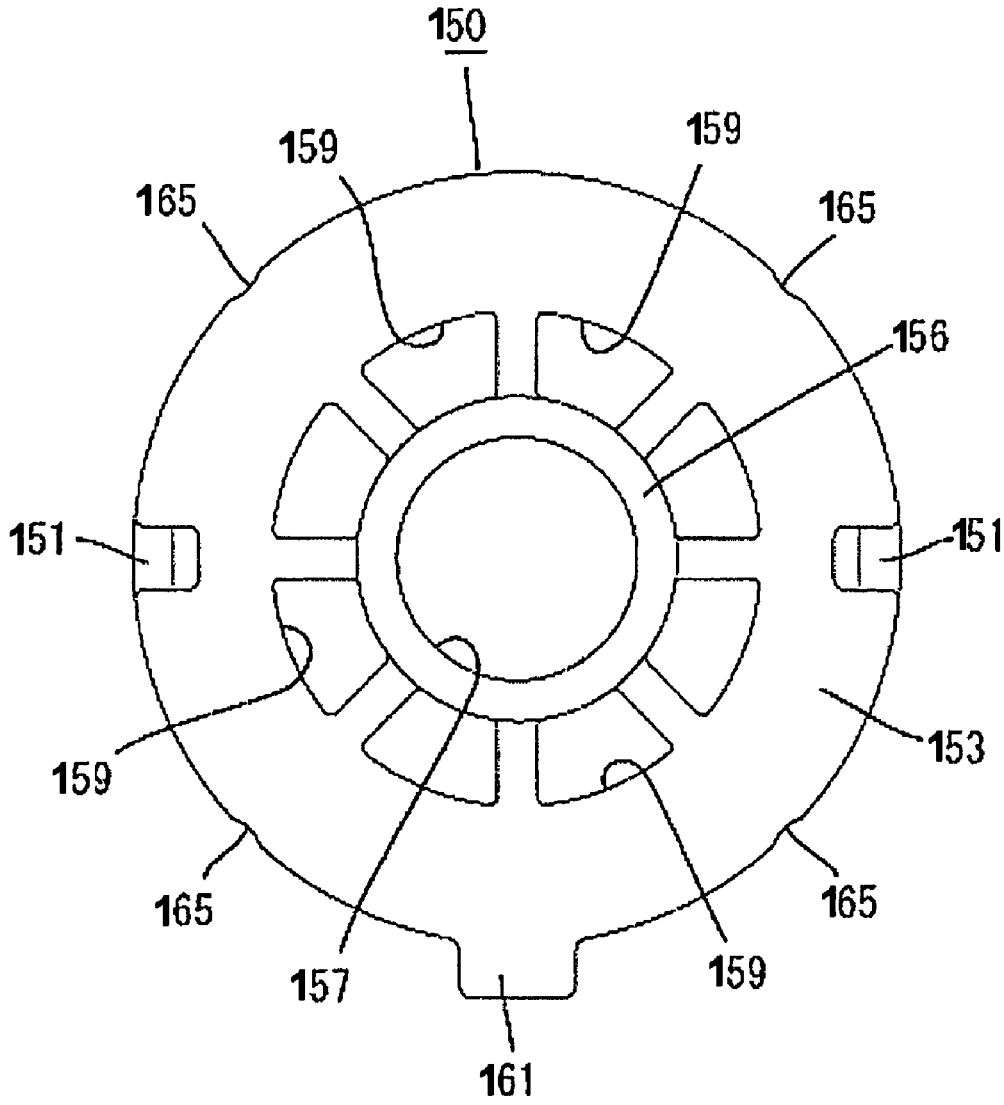
FIG. 16 is a rear view of the rear holder.

The rear holder 150 is made of a synthetic resin and defines a cap shape, as shown in FIGS. 14 to 16. More particularly, the rear holder 150 includes a substantially disk-shaped back wall 153 and a substantially cylindrical surrounding wall 154 projects forward from the peripheral edge of the back wall 153. The surrounding wall 154 is fittable on the mounting portion 115 form behind and the back wall 153 can partly close the opening of the mounting portion 115 to retain the seal 198.

A wire insertion hole 155 is formed in the center of the back wall 153 and can receive the wire W. A substantially cylindrical tube 156 projects back from the rear surface of the back wall 153, and a wire insertion path 157 extends through the tube 156. The wire insertion path 157 communicates coaxially with the wire insertion hole 155 and has the same diameter as the wire insertion hole 155. The wire W connected with the terminal fitting 130 is inserted through and held in the wire insertion hole 155 and in the wire insertion path 157, while having loose movements thereof prevented. A length of the tube 156 in forward and backward directions FBD is less than the length of the surrounding wall 154, preferably less than about ⅔ of the length of the surrounding wall 154, most preferably about half the length of the surrounding wall 154. Further, an inner fitting 158 projects forward from the inner front surface of the back wall 153 except the outer peripheral edge thereof. This inner fitting 158 has an outer peripheral edge substantially concentric with the back wall 153 and an inner peripheral edge defining the wire insertion hole 155. The front surface of the inner fitting 158 is a substantially vertical flat surface that it can be held substantially in surface contact with the rear surface of the seal 198. This inner fitting 158 fits closely into the mounting portion 115 so that the outer circumferential surface of the inner fitting 158 closely contacts the inner circumferential surface of the mounting portion 115. A fitting space is defined between the outer circumferential surface of the inner fitting 158 and the inner circumferential surface of the mounting portion 115 and receives a rear opening edge of the mounting portion 115. Recesses 159 are formed in the outer rear surface of the back wall 153 at positions corresponding to the inner fitting 158 to prevent surface sinks in the back wall 153.

A bulge 161 extends in forward and backward directions FBD on the bottom of the surrounding wall 154 of the rear holder 150. The bulge 161 has a U-shaped cross section, and a guidable groove 152 is formed in this bulge 161. The guiding rib 136 of the mounting portion 136 engages the guidable groove 152 of the bulge 161 to guide the mounting of the rear holder 150 on the mounting portion 136 and to prevent rotation of the rear holder 150 about its central axis. The bulge 161 interferes with the rear opening edge of the mounting portion 115 if an attempt is made to mount the rear holder 150 on the mounting portion 115 in an improper posture to hinder any further mounting. Thus, the improper posture of the rear holder 150 can be recognized at the start of the mounting operation of the rear holder 150.

Locking pieces 151 are formed at the left and right sides of the surrounding wall 154 and engage with the interlocking portions 134 of the mounting portion 115. Each locking piece 151 is substantially a U-shaped frame, and is resiliently deformable in and out between upper and lower slits 162 that open at the front end of the surrounding wall 154 and extending backward. A rearwardly open locking groove 163 extends back along the locking piece 151, but is not open at the front end of the locking piece 151. The front ends of the locking pieces 151 move onto the interlocking portions 134 in the process of mounting the rear holder 150 on the mounting portion 115 and hence the locking pieces 151 deform. The interlocking portions 134 align with the locking grooves 163 when the rear holder 150 is mounted properly and the locking pieces 151 restore resiliently to engage the interlocking portions 134 for locking the rear holder 150 on the mounting portion 115.

Four leading-end widened ribs 164 are provided on the inner circumferential surface of the surrounding wall 154 and are spaced apart at circumferential intervals of about 90°. Each leading-end widened rib 164 has an isosceles trapezoidal cross section that gradually widens from the base end towards the projecting end. The leading-end widened ribs 164 extend over substantially the entire length of the surrounding wall 154 in forward and backward directions FBD, so that the front ends thereof are near a front opening edge of the rear holder 150 and the rear ends thereof are near the front surface of the back wall 153. The locking pieces 151 are between and substantially equidistant from the leading-end widened ribs 164 on the corresponding side of the rear holder 150. The leading-end widened ribs 164 are at positions to face the recesses 137 when the rear holder 150 is opposed to the mounting portion 115 and are engageable with the dovetail recesses 137. Thus, the leading-end widened ribs 164 and the recesses 137 lock to each other in radial directions.

Recessed grooves 165 are formed in the outer circumferential surface of the surrounding wall 154 at positions aligned radially with the leading-end widened ribs 164 to define a back-to-back relationship. The recessed grooves 165 have a shallow arcuate cross section and extend in forward and backward directions FBD over the entire length of the surrounding wall 154. The recessed grooves 165 and the leading-end widened ribs 164 are substantially transversely symmetrical with respect to an axial line along a radial direction.

The connector is assembled by first inserting the terminal fitting 130 connected with the end of the wire W into the cavity 116 of the female housing 110. The terminal fitting 130 passes through the mounting portion 115 and is locked in the tower 113 by the lock 117. The seal 198 mounted on the end of the wire W is fit and held in the mounting portion 115 as the terminal fitting 130 is inserted properly into the cavity 116. Further, the seal ring 197 is mounted on the rear end of the tower 113. The wire W is inserted through the wire insertion hole 155 and the wire insertion path 157 of the rear holder 150, and the rear holder 150 is held on standby at an intermediate position of the wire W along its extending direction.

The rear holder 150 then is mounted on the mounting portion 115 from behind. At this time, the guiding rib 136 of the mounting portion 115 is inserted into the entrance of the guidable groove 152 of the rear holder 150, and the leading-end widened ribs 164 of the rear holder 150 are inserted into the entrances of the recesses 137 of the mounting portion 115. The leading-end widened ribs 164 are positioned precisely in the recesses 137 by aligning the recessed grooves 165 in the outer circumferential surface of the rear holder 150 with the mating recesses 137. The rear holder 150 then is pushed forward along the recesses 137 in this state. As a result, the frames 135 of the mounting portion 115 enter the slits 162 of the surrounding wall 154 from the front and the leading ends of the locking pieces 151 slide onto the guiding surfaces of the interlocking portions 134 to deform the locking pieces 151. The inner fitting portion 158 of the back wall 153 fits into the rear opening edge of the mounting portion 115 when the rear holder 150 is mounted on the mounting portion 115 to a proper depth and retains the seal 198 in the mounting portion 115. Additionally, the interlocking portions 134 fit into the locking grooves 163 as the locking pieces 151 are restored resiliently. The locking pieces 151 engage the locking surfaces of the interlocking portions 134 in a detaching direction of the rear holder 150 to retain the rear holder 150 reliably. The front ends of the leading-end widened ribs 164 are held in contact with the front surfaces of the recesses 137 and the locking pieces 151 are surrounded by the frames 135 of the mounting portion 115 when the rear holder 150 is mounted on the mounting portion 115 to a proper depth.

The tower 113 then is fit into the receptacle 191 of the mating male housing 190. The lock arm 112 resiliently engages the lock 195 to lock the two housings 110, 190 together when the female and male housing 110, 190 are connected properly with each other. Additionally, the unlocking portions 189 unlock the detector 199 and the detector 199 is pushed in to the detecting position. An operator knows that the two housings 110, 190 are left partly connected if the detector 199 cannot be pushed in. Therefore the two housings 110, 190 connected more deeply to reach a properly connected state. Further, the male tab 192 is inserted to a proper depth in the main portion 131 of the terminal fitting 130 when the two housings 110, 190 are connected properly to connect the terminal fittings 30, 192 and the inner circumferential surface of the receptacle 191 closely contacts the outer circumferential surface of the seal ring 197 to provide sealing between the two housings 110, 190.

A wire drawn out from a female housing may be shaken in a direction intersecting the longitudinal direction after the two housings are connected. In this situation, a pulling force could act on a rear holder in the same direction intersecting the longitudinal direction. These forces could cause the rear holder to incline within the range of a clearance to the mounting portion and, in a worst case, interlocking portions could separate to unlock the rear holder. However, according to this embodiment, the dovetail engagement of the leading-end widened ribs 164 and the recesses 137 in radial directions hold the rear holder 150 and the mounting portion 115 in close contact even if a pulling force acts on the rear holder 150.

As described above, according to this embodiment, the detachment of the rear holder 150 from the mounting portion 115 is hindered by the dovetail engagement of the leading-end widened ribs 164 and the recesses 137. Thus, the seal ring 197 cannot inadvertently come out of the mounting portion 115. Additionally, the leading-end widened ribs 164 are formed up to the back wall 153. Thus, a shaking force of the wire W is suppressed at a shake supporting part of the wire W, and detachment of the rear holder 150 is hindered.

The surrounding wall 154 of the rear holder 150 is a substantially cylindrical tube. The leading-end widened ribs 164 are on the inner circumferential surface of the surrounding wall 154 where they cannot be seen from the outside, and the mounting operation of the rear holder 150 is stopped if the rear holder 150 is rotated about its central axis from a proper rotational alignment. However, according to this embodiment, the recessed grooves 165 are formed at positions on the outer circumferential surface of the surrounding wall 154 corresponding to the leading-end widened ribs 164. The recessed grooves function as markers for positioning upon mounting the rear holder 150. In other words, the rear holder 150 can be mounted in a proper posture on the mounting portion 115 by starting the mounting operation of the rear holder 150 in a state where the recessed grooves 165 and the recesses 137 align.

The recessed grooves 165 are formed back-to-back with the leading-end widened ribs 164. Thus, parts of the surrounding wall 154 where the leading-end widened ribs 164 are formed are not excessively thickened, and surface sinks will not occur. Furthermore, the inner fitting 158 of the rear holder 150 is fit into the mounting portion 115. Thus, even if the wire W is shaken a large amount, the inner fitting 158 and the mounting portion 115 are engaged with each other in a shaking direction intersecting the longitudinal direction and the inner fitting 158 is caught by the mounting portion 115. Therefore the detachment of the rear holder 150 is prevented reliably.

The tower 113 and the receptacle 191 may be displaced relative to each other due to dimensional tolerances and the like or their relative positions may change due to an external force in the connected state of the female and male housings 110, 190. However, the projecting ends of the ribs 193 and the irregularly shaped ribs 120 can be brought reliably into contact with each other since the irregularly shaped ribs 120 include circumferentially extending parts (e.g. receiving bases 122B) and can support the ribs 193 within their formation ranges. As a result, a shake that can occur between the two housings 110, 120 can be suppressed. Further, in this case, the irregularly shaped ribs 120 project from the tower 113 towards the receptacle 191 and the ribs 193 project from the receptacle 191 towards the tower 113. Thus, the projecting distance of the irregularly shaped ribs 120 can be suppressed as compared to the case where the ribs project from only one of the tower 113 and the receptacle 191. As a result, the strength of the ribs is increased and they are less likely to break.

Further, since the irregularly shaped ribs 120 include the T-shaped ribs 122 each comprised of the supporting strut 122A and the receiving base 122B. Thus, an sinks in the supporting struts 122A can be prevented even if the formation ranges of the receiving bases 122B are enlarged.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Although the rear holder is provided with the tube in the first embodiment, it may not be provided with the tube. In this case, the main body of the seal may closely contact the inner circumferential surface of the wire insertion hole in the back wall of the rear holder.

Although the seal is made of rubber in the first embodiment, it may be made of gel or any other resilient material according to the present invention.

The invention is also applicable to the case where a seal is fit at least partly into a rear part of a male housing for accommodating a male terminal fitting and a rear holder is mounted thereon.

Contrary to the second embodiment, the recesses may be formed in the inner circumferential surface of the surrounding wall of the rear holder and the leading-end widened ribs may be formed on the outer circumferential surface of the mounting portion.

Contrary to the second embodiment, the ribs may be formed on the outer circumferential surface of the tower and the leading-end widened portions may be formed on the inner circumferential surface of the receptacle.

Although the leading-end widened ribs are dovetail ribs and the recesses are dovetail recesses in the second embodiment, it is sufficient for the leading-end widened ribs and the recesses to be able to provide dovetail engagements. For example, it does not matter even if the leading-end widened ribs have a T-shaped cross section.

Although the leading-end widened portions and the projecting portions are formed to extend in forward and backward directions, respectively, as the irregularly shaped ribs and the ribs in the second embodiment, it is sufficient for them to be arranged at positions where they can be brought into contact with each other when the female and male housings are connected properly according to the invention, and the leading-end widened portions and the projections may be formed as mere projections.

What is claimed is:

1. A connector, comprising:

a housing with an opening defining an interior of the housing;

at least one terminal fitting accommodated in the housing;

a wire connected with the terminal fitting;

at least one seal mounted on the wire and fit into the opening in the housing for sealing the interior of the housing; and a holder having a cap shape with a back wall and a surrounding wall projecting forward from the back wall, the holder being mountable on a mounting portion of the housing from a mounting side, the back wall being formed with at least one wire insertion hole for receiving the wire drawn out from the housing, the back wall of the holder further having an inner fitting to be fit into the mounting portion while holding the mounting portion in a thickness direction together with the surrounding wall;

at least one leading-end widened rib extending in substantially forward and backward directions on one of an inner circumferential surface of the surrounding wall and an outer circumferential surface of the mounting portion, the leading-end widened rib having a leading end wider than a base end; and at least one recess on the other of the inner circumferential surface of the surrounding wall and the outer circumferential surface of the mounting portion at a position substantially corresponding to the leading-end widened rib, the recess having a shape corresponding to the leading-end widened rib for dovetail engagement therewith, one of the leading-end widened rib and the recess extending substantially up to the back wall of the holder.

2. The connector of claim 1, wherein: the surrounding wall of the holder is substantially cylindrical, the leading-end widened rib is provided on the inner circumferential surface of the surrounding wall, and at least one recessed groove is formed in the outer circumferential surface of the surrounding wall at a position substantially having a back-to-back relationship with the leading-end widened rib.

3. The connector of claim 1, wherein the mounting portion is substantially tubular and has an open rear surface.

* * * * *